US010589279B2

(12) United States Patent
Berger et al.

(10) Patent No.: US 10,589,279 B2
(45) Date of Patent: Mar. 17, 2020

(54) WATER RELIEF GROOVE TO PREVENT CAVITATION OF OPPOSITE REFINER PLATE

(71) Applicant: Andritz Inc., Glens Falls, NY (US)

(72) Inventors: Marc Berger, Pont-Rouge (CA); Luc Gingras, Harrogate (GB)

(73) Assignee: Andritz Inc., Glens Falls, NY (US)

( * ) Notice: Subject to any disclaimer, the term of this patent is extended or adjusted under 35 U.S.C. 154(b) by 0 days.

(21) Appl. No.: 16/220,377

(22) Filed: Dec. 14, 2018

(65) Prior Publication Data

US 2019/0184404 A1 Jun. 20, 2019

Related U.S. Application Data

(60) Provisional application No. 62/599,127, filed on Dec. 15, 2017.

(51) Int. Cl.
*B02C 7/12* (2006.01)
*D21D 1/30* (2006.01)

(52) U.S. Cl.
CPC ..... *B02C 7/12* (2013.01); *D21D 1/306* (2013.01)

(58) Field of Classification Search
CPC ..... D21D 1/30; D21D 1/303; D21D 1/306; B02C 15/003; B02C 18/365; B02C 7/12
See application file for complete search history.

(56) References Cited

U.S. PATENT DOCUMENTS 4,953,796 A 9/1990 Virving
5,580,472 A 12/1996 Maybon
5,988,538 A * 11/1999 Bartels ..... B02C 7/12 241/244
6,402,071 B1 * 6/2002 Gingras ..... B02C 7/12 241/261.2
6,616,078 B1 9/2003 Gingras
6,935,589 B1 * 8/2005 Matthew ..... B02C 7/12 241/261.3
7,300,550 B2 * 11/2007 Sabourin ..... B02C 7/12 162/23

(Continued)

FOREIGN PATENT DOCUMENTS

WO 98/33594 8/1998

OTHER PUBLICATIONS

Shane Thomas, International Search Report and Written Opinion, dated Mar. 31, 2019, pp. 1-22, Alexandria, VA, USA.

(Continued)

*Primary Examiner* — Adam J Eiseman
*Assistant Examiner* — Bobby Yeonjin Kim
(74) *Attorney, Agent, or Firm* — Robert Joseph Hornung

(57) ABSTRACT

This disclosure relates to a refiner plate segment, mechanical refiners, and methods to manufacture a refiner plate segment having one or more water channels disposed in a variable substrate profile along the radial length of a refiner plate segment base and disposed between the refiner plate segment inlet and the primary refining section, wherein the variable substrate profile comprises an undulating curve configured to complement a second undulating curve on an opposing refiner plate, and wherein dimensions of the one or more water channels are sufficiently narrow to prevent wood chips from entering the water channels and sufficiently wide to provide a bypass path for the free water.

21 Claims, 11 Drawing Sheets

(56) References Cited

U.S. PATENT DOCUMENTS

| | | | | |
|---|---|---|---|---|
| 2005/0161542 | A1* | 7/2005 | Theut | B02C 7/12 241/298 |
| 2006/0006265 | A1 | 1/2006 | Sabourin | |
| 2008/0191078 | A1* | 8/2008 | Gingras | D21D 1/306 241/298 |
| 2010/0314476 | A1* | 12/2010 | Vuorio | B02C 7/12 241/101.2 |
| 2012/0032011 | A1* | 2/2012 | Ruola | B02C 7/12 241/277 |
| 2013/0015281 | A1* | 1/2013 | Gingras | D21D 1/306 241/296 |
| 2013/0320119 | A1* | 12/2013 | Gingras | B02C 7/12 241/28 |
| 2014/0196858 | A1* | 7/2014 | Gingras | B02C 7/12 162/4 |
| 2017/0275819 | A1 | 9/2017 | Gingras | |
| 2018/0345291 | A1* | 12/2018 | Knight | B02C 7/04 |

OTHER PUBLICATIONS

Vincent Pellerin, Canadian Office Action, dated Jul. 15, 2019, pp. 1-4, Canada.

* cited by examiner

WATER RELIEF GROOVE TO PREVENT CAVITATION OF OPPOSITE REFINER PLATE

CROSS-RELATED APPLICATION

This application claims the benefit under 35 U.S.C. § 119(e) of the earlier filing date of U.S. Provisional Patent Application No. 62/599,127 filed on Dec. 15, 2017, the entire contents of which are incorporated herein by reference.

BACKGROUND OF THE INVENTION

1. Technical Field

The present disclosure relates generally to refiners for lignocellulosic material and more particularly to refiner plate segments for a refiner.

2. Related Art

Mechanical pulping refiners typically separate, develop, and cut lignocellulosic material into fibers to endow the fibers with certain mechanical and physical properties suitable for use in pulp, paper, boards, building materials, packing materials, liquid-absorbent filler materials, and other products.

A mechanical refiner typically comprises two or more opposing refiner assemblies. Each assembly has a pattern of raised refining bars on a refining side. Grooves separate adjacent refining bars. Typically, these refining assemblies are either circular discs, annular discs, or nested conical frustums configured to rotate around a common axis. Each refiner assembly may comprise several annular sector-shaped segments bolted to a backing structure to form the refiner circular disc, refiner annular disc, or refiner conical frustum. The refining sides of the opposing refining assemblies face each other to define a narrow refining gap separating the opposing refiner assemblies. At least one of the refining assemblies is a rotor configured to rotate around the axis.

As the rotor refining assembly spins at high speeds, operators feed lignocellulosic material or other feed material through the refining gap. The refining bars and grooves on opposing refiner assemblies successively overlap as the rotor spins. A typical rotor refiner assembly spins in a range of 900 to 2,300 rotations per minute ("rpm"). The successively overlapping opposing bars and grooves alternatively compress and permit the expansion of lignocellulosic material in the refining gap. This rapid alternating compression and expansion creates a fiber pad, which is the primary location where mechanical refining occurs. In other words, forceful movement of feed material against adjacent feed material in the fiber pad contributes primarily to the fiber's development, separation, and cutting. This is known as "primary refining."

As the mechanical refiner breaks down lignocellulosic material, some water may be released in the form of steam. This steam separates into a "forward-flowing" portion, which flows out of the refining gap with the refined fiber, and a "back-flowing" portion, which will flow back toward the refiner plate segments' inlets. Generally, the operators thermally soften lignocellulosic material prior to the primary refining step, and the back-flowing steam is typically the principle heat source for thermally softening the lignocellulosic feed material. However, the back-flowing steam tends to thermally soften the feed material inconsistently in part due to the feed particles' inconsistent size.

The feed material tends to be inconsistent in size, and many conventional refiner plates fail to break down the feed material (e.g. the lignocellulosic material) sufficiently prior to feeding the feed material into the refining gap for primary refining. As a result, mechanical refiners typically distribute energy unevenly over inconsistently sized feed material, which can lead to non-uniform refining. That is, larger particles tend to suffer more fiber damage (typically in the form of cutting) than smaller particles when the larger particles enter the primary refining section.

The few refiner plates that do break down the feed material sufficiently tend to suffer from a lack of feeding intensity control, a lack of feed distribution control, and/or an increased negative interaction between the back-flowing steam and the feed material.

To address these problems, Applicant developed the refiner plate segment described in U.S. Pat. No. 6,616,078, "Refiner Plate with Chip Conditioning Inlet," the entirely of which is incorporated herein by reference (the "'078 patent"). The '078 patent describes refiner plates having a wave-like variable base profile extending along a radial length of the refiner plate segment base positioned radially inward of the primary refining bars. The variable base profile on a first refiner plate segment directs feed material to the opposite refiner plate segment at a first fixed radial location. The second opposing refiner plate segment's variable base profile then directs the same feed material to back to the first refiner plate segment at a second fixed radial position. The second fixed radial position is disposed radially outward from the first fixed radial position.

However, the design disclosed in the '078 patent would also deflect excess steam and dilution water to the fixed radial positions constantly. The '078 patent's design led to substantial cavitation where water hit the opposite segment. Cavitation damage tended to be most severe where the water was first deflected to the opposite refiner plate segment. This problem contributed to a significant loss of useful life for the refiner plate segments.

SUMMARY OF THE INVENTION

There is a need for the development of a variation of the invention disclosed in the '078 patent in which all the features of wood chip transportation are preserved, but an alternate path for the free water coming into the refiner feed is created in order to prevent the cavitation of the refiner plate elements and thus extend the useful plate life to acceptable levels.

The problem of cavitation on refiner plate segments having a variable base profile along the radial length of a refiner plate segment base and disposed between the refiner plate segment inlet and the primary refining section, wherein the variable base profile comprises an undulating curve configured to complement a second undulating curve on an opposing refiner plate segment is solved by the addition of one or more water channels disposed adjacent to a high point of an undulating curve, wherein dimensions of the one or more water channels are sufficiently narrow to prevent wood chips from entering the water channels and sufficiently wide to provide a bypass path for the free water as more fully described in accordance with this present disclosure. It is contemplated that the water channels as more fully described herein could eliminate most or substantially all of the free water that would otherwise hit the opposing refiner plate segment at a fixed radial position.

The water channels may have a depth of one-half up to the full height of the profile of the bump that is used to deflect the wood chips into the opposite element. In other exemplary embodiments, the depth of the water channels may be deeper than the full height of the bump profile. Preferably, the channels would be in the area of 2-5 mm wide in order to prevent the wood chips from passing through the channels easily. The small fine particles may pass though the channels, but these very small fine particles do not need pretreatment, (e.g. grinding the feed material to a more uniform average size prior to refining). Different embodiments may have different a different number of channels. In a preferred embodiment, the number of channels is such that the channels sufficiently redirect water that would otherwise be pushed across the gap and hit the opposite refiner plate element. This number may be at least as large as the number of feeding bars (i.e. the wide bars, or "breaker bars") reaching toward the inlet of the first rotor element. Ideally, the water channels have a profile that sees their width open up slightly when going from the refiner plate's inlet side toward the periphery, in order to ensure as much as possible that any solid particle entering such a water notch does not end up trapped in the said notch.

In certain exemplary embodiments, a refiner plate segment may have at least one water channel. In other exemplary embodiments, the refiner plate segment may have two or more water channels.

The amount of water channels, the dimensions of the water channels, and the position of the water channels in the breaker bar section (or "feeding section") may be configured to optimize the flow of free water to travel outward toward the refining section without being deflected to a fixed radial position on the opposite refiner plate segment. In this manner, the exemplary embodiments further described herein prevent severe cavitation at discrete radial positions on the refiner plate segments.

BRIEF DESCRIPTION OF THE DRAWINGS

The foregoing will be apparent from the following more particular description of exemplary embodiments of the disclosure, as illustrated in the accompanying drawings. The drawings are not necessarily to scale, with emphasis instead being placed upon illustrating the disclosed embodiments.

DETAILED DESCRIPTION OF THE INVENTION

Figure 1A:
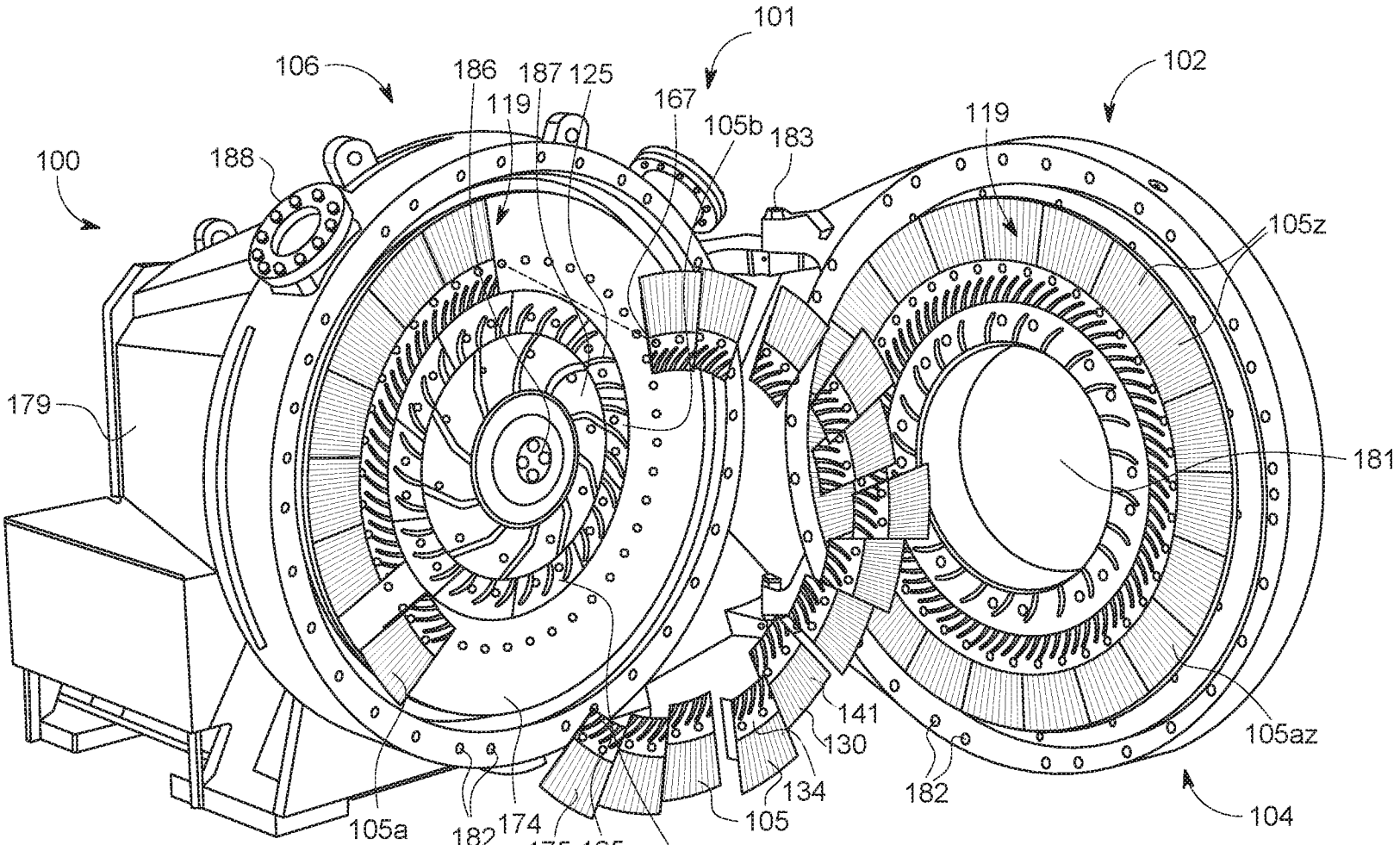
FIG. 1A (prior art)
FIG. 1A is a partially exploded perspective view of a mechanical disc refiner depicting how refiner plate segments may be mounted to the backing structure.

The following detailed description of the preferred embodiments is presented only for illustrative and descriptive purposes and is not intended to be exhaustive or to limit the scope and spirit of the invention. The embodiments were selected and described to best explain the principles of the invention and its practical application. One of ordinary skill in the art will recognize that many variations can be made to the invention disclosed in this specification without departing from the scope and spirit of the invention.

Similar reference characters indicate corresponding parts throughout the several views unless otherwise stated. Although the drawings represent embodiments of various features and components according to the present disclosure, the drawings are not necessarily to scale and certain features may be exaggerated in order to better illustrate embodiments of the present disclosure, and such exemplifications are not to be construed as limiting the scope of the present disclosure.

Except as otherwise expressly stated herein, the following rules of interpretation apply to this specification: (a) all words used herein shall be construed to be of such gender or number (singular or plural) as to circumstances require; (b) the singular terms "a," "an," and "the," as used in the specification and the appended claims include plural references unless the context clearly dictates otherwise; (c) the antecedent term "about" applied to a recited range or value denotes an approximation within the deviation in the range or values known or expected in the art from the measurements; (d) the words "herein," "hereby," "hereto," "hereinbefore," and "hereinafter," and words of similar import, refer to this specification in its entirety and not to any particular paragraph, claim, or other subdivision, unless otherwise specified; (e) descriptive headings are for convenience only and shall not control or affect the meaning or construction of any part of the specification; and (f) "or" and "any" are not exclusive and "include" and "including" are not limiting. Further, the terms, "comprising," "having," "including," and "containing" are to be construed as open-ended terms (i.e., meaning "including but not limited to").

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

To the extent necessary to provide descriptive support, the subject matter and/or text of the appended claims is incorporated herein by reference in their entirety.

Recitation of ranges of values herein are merely intended to serve as a shorthand method of referring individually to each separate value falling within the range of within any sub ranges there between, unless otherwise clearly indicated herein. Each separate value within a recited range is incorporated into the specification or claims as if each separate value were individually recited herein. Where a specific range of values is provided, it is understood that each intervening value, to the tenth or less of the unit of the lower limit between the upper and lower limit of that range and any other stated or intervening value in that stated range or sub range hereof, is included herein unless the context clearly dictates otherwise. All subranges are also included. The upper and lower limits of these smaller ranges are also included therein, subject to any specifically and expressly excluded limit in the stated range.

It should be noted that some of the terms used herein are relative terms. For example, the terms "upper" and "lower" are relative to each other in location, i.e. an upper component is located at a higher elevation than a lower component in a given orientation, but these terms can change if the device is flipped. The terms "inlet' and "outlet" are relative to a fluid flowing through them with respect to a given structure, e.g. a fluid flows through the inlet into the structure and flows through the outlet out of the structure. The terms "upstream" and "downstream" are relative to the direction in which a fluid flows through various components, i.e. the flow of fluids through an upstream component prior to flowing through the downstream component.

The terms "horizontal" and "vertical" are used to indicate direction relative to an absolute reference, i.e. ground level. However, these terms should not be construed to require structure to be absolutely parallel or absolutely perpendicular to each other. For example, a first vertical structure and a second vertical structure are not necessarily parallel to each other. The terms "top" and "bottom" or "base" are used to refer to locations/surfaces where the top is always higher than the bottom/base relative to an absolute reference, i.e. the surface of the Earth. The terms "upwards" and "downwards" are also relative to an absolute reference; an upwards flow is always against the gravity of the Earth.

Figure 1B:
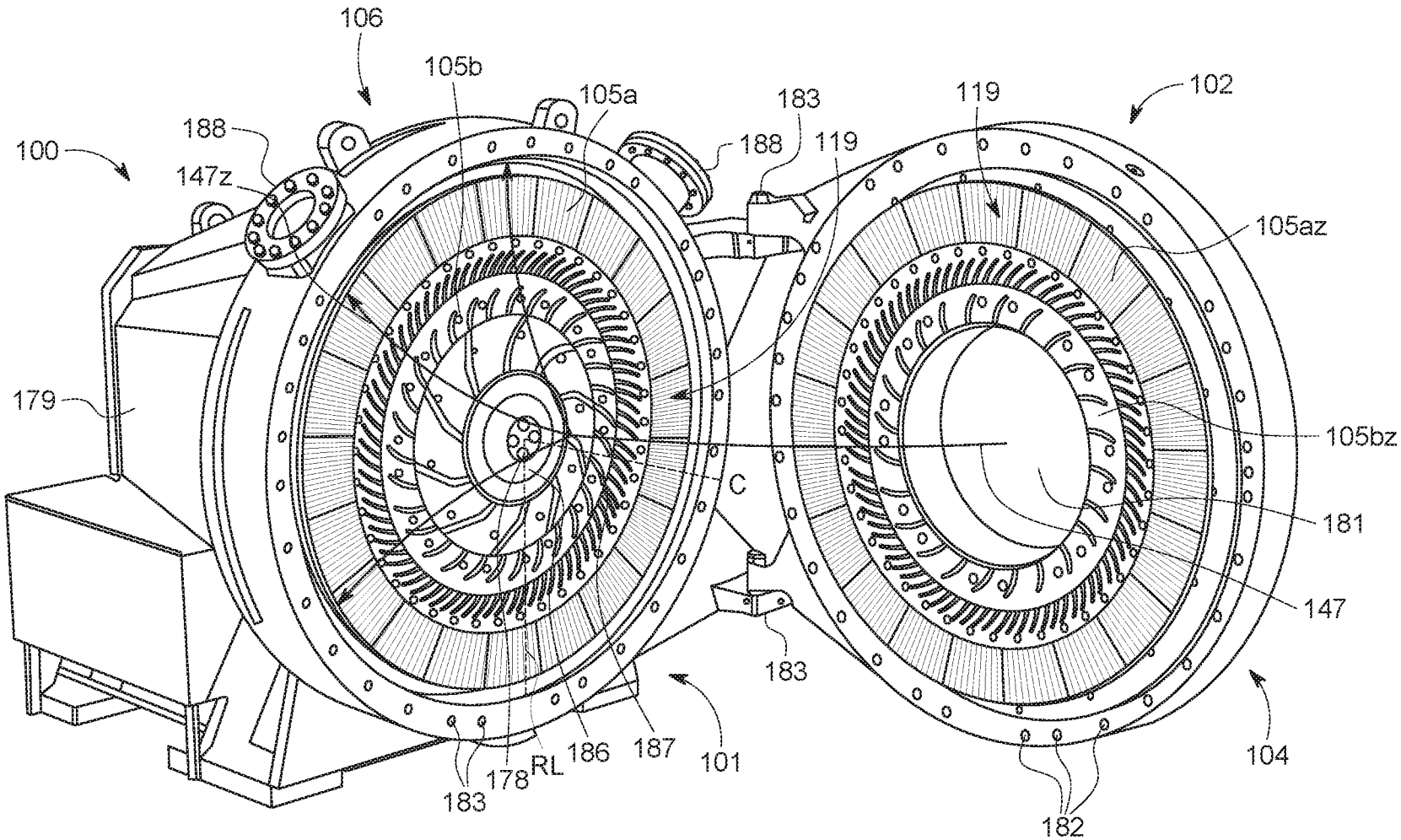
FIG. 1B (prior art)
FIG. 1B is a perspective view of a fully assembled mechanical disc refiner showing an open rotor side and stator side.

FIG. 1A depicts an example mechanical disc refiner 100 having a rotor refining assembly 101 oppositely disposed from a stator refining assembly 102. The rotor and stator assemblies 101, 102 sit within a housing 179. Each refining assembly 101, 102 comprises a plurality of refiner plate segments 105 annularly arrayed to form a ring mounted on the backing structure 174. FIG. 1 shows the stator side 104 of the housing 179 open around hinges 183 to better depict the respective refining assemblies 101, 102. However, during operation, the stator side 104 is closed around the hinge 183 and bolts (not depicted) extend through the respective bolt holes 182 to fixedly engage the stator side 104 of the housing 179 to the rotor side 106. When the stator refining assembly 102 and rotor refining assembly 101 face each other, the stator refining assembly 102 and the rotor refining assembly 101 define a gap 449 (FIG. 4) between the front surfaces 119 of the opposing refiner plate segments 105, 105$z$. It will be understood that other mechanical refiners have different access mechanisms (i.e. not necessarily a hinge 183).

For large diameter mechanical refiners 100, one or more rings of intermediate refiner plate segments may be disposed between a breaker bar segment 105$_b$ and an outer refiner plate segment 105$_a$. However, it will also be understood that such intermediate rings are rare. Bolts or fasteners may extend through fastener holes 167 to engage the refiner plate segments 105 to the backing structure 174 and thereby fixedly engage the annular sector-shaped refiner plate segments 105 to the backing structure 174.

As used herein and unless otherwise specified, "refiner plate segment" 105 can refer to a refiner plate segment 105 having an integrated refining section 175 and breaker bar section 134 (see FIG. 2A), breaker bar segments 105$_b$ (see FIG. 3A), and a refiner plate segment comprising a refining section 175 but lacking a breaker bar section 134. In embodiments having outer refiner plate segments 105$_a$ and breaker bar segments 105$_b$, the outer refiner plate segments 105$_a$ may still comprise an integrated refining section 275 (FIG. 2A) and breaker bar section 234. However, the breaker bars 125 on an outer refiner plate segment 105$_a$ are generally smaller than the breaker bars 125 on a breaker bar segment 105$_b$. When mounted on a backing assembly 174, the breaker bar segments 105$_b$ are disposed radially inward from the outer refiner plate segments 105$_a$.

In an active mechanical refiner 100, feed material 147 (FIG. 1B), which may be lignocellulosic feed material (commonly in the form of wood chips), flows through an opening 181 in the center of the stator refining assembly 102 before encountering the rotor hub 186 or rotor flinger 187. The rotor refining assembly 101 typically rotates around the center of rotation C (FIG. 1B) in a range of 900 to 2,300 rpm, and thereby flings the feed material 147 radially outward into the gap 449. Breaker bars 125 may break down the feed material 147 before the feed material 147 flows still further through the gap 449 and traverses a refining section 175 defined by alternating refining bars 130 and refining grooves 141 on opposing refiner plate segments 105$_a$ and 105$_a z$. The refined and partially-ground material 147$z$ exits the mechanical refiner 100 through an outlet 188. Operators may then screen the refined material from the partially ground material and transfer the partially ground material to a second stage refiner. Operators may treat the partially ground material in lieu of or in addition to subjecting the partially ground material to further refining.

Furthermore, although not depicted, it will be understood that exemplary refiner plate segments disclosed herein may also be configured for use in a conical mechanical refiner. It will also be understood that exemplary refiner plate segments disclosed herein may also be configured for use in a disc-conical mechanical refiner, which includes both flat disc surface and a conical surface. Other types of mechanical refiners 100 compatible with the disclosed refiner plate segments 105 include, but are not necessarily limited to, counter-rotating refiners comprising two counter-rotating rotor assemblies 101, and multi-assembly refiners comprising multiple refining assemblies (see 101 and 102).

Operators generally add dilution water (see 245, FIG. 2) with the feed material 147 to the mechanical refiner 100.

This dilution water combines with the feed material 147 once the feed material 147 becomes well separated in the refining section 175. The dilution water is free flowing and generally comprises a majority of the free water 245 flowing through the gap 449. When the feed material 147 is lignocellulosic material or other biological material containing entrapped water, mechanical refining also releases the entrapped water, which contributes slightly to the amount of free (liquid) water 245 in the system.

Applicant developed refiner plate segments having a variable substrate profile 210 (FIG. 2B) as more fully described in U.S. Pat. No. 6,616,078. The variable substrate profile 210 successfully facilitated feed material distribution into the refining section 175, improved control of feeding intensity, and decreased the negative interaction between back-flowing steam and the feed material 147. However, without being bounded by theory, Applicant believes that the variable substrate profile 210 also directed free water 245 across the gap 449 at a substantially constant radial position (see $RP_1$, FIG. 4B), which led to cavitation on the opposing refiner plate segment 105*z*. To address this problem, Applicant includes water channels 250 in accordance with the present disclosure.

Figure 2A:
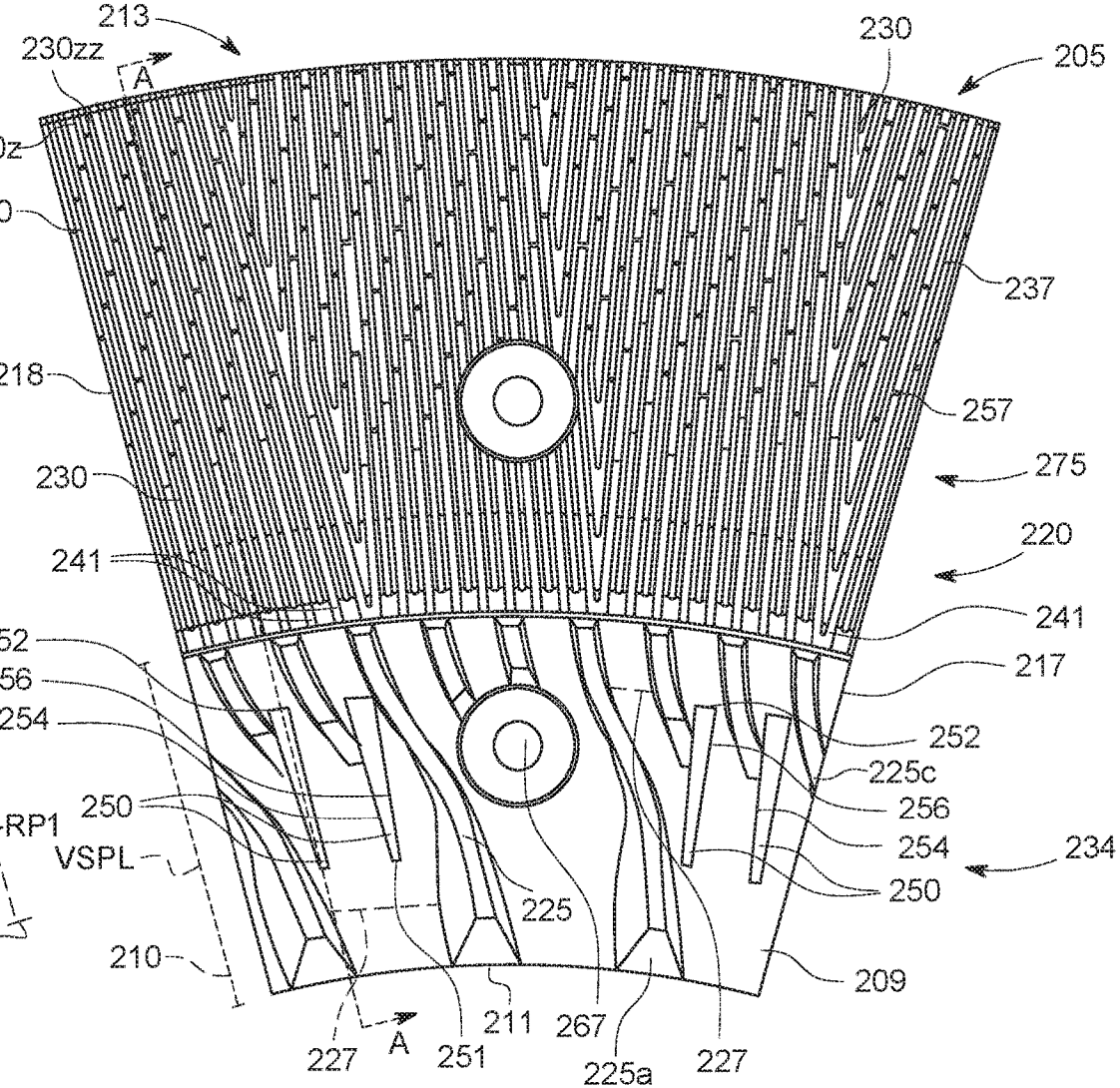
FIG. 2A depicts an exemplary rotor refiner plate segment having exposed water channels in the breaker bar section.

FIG. 2A illustrates an exemplary rotor refiner plate segment 205 having water channels 250 disposed in a breaker bar section 234. The breaker bar section 234 has a variable substrate profile 210. In the depicted embodiment, the water channels 250—particularly the channel bottoms 253 (FIG. 2B) of the water channels 250—are entirely exposed to the gap 449. Stated differently, the depth of the water channel 250 corresponds to the full height of the profile of the bump 294, i.e. the water channel 250 cuts through the variable substrate profile crest 239 (see also FIG. 8). As such, there is no top 658 (FIG. 6) of the water channel 250 in the embodiment of FIG. 2A.

The refiner plate segment 205 comprises a substrate 209. The substrate 209 has a radial length RL (FIG. 2B) extending from a narrow side 211 to a wide side 213 distally located from the narrow side 211. The substrate 209 further comprises a first lateral side 217 and a second lateral side 218 distally disposed from the first lateral side 217. The first lateral side 217 and the second lateral side 218 extend between the narrow side 211 and the wide side 213 along the radial length RL. The substrate 209 has a back surface 212 (FIG. 2B) oppositely disposed from a front surface 219 along the substrate's thickness T. The back surface 212 and the front surface 219 extend between the wide side 213, narrow side 211, first lateral side 217, and the second lateral side 218. The thickness $T_1$ may be thinner at the narrow side 211 than a thickness $T_2$ disposed distally from the narrow side 211 along the radial length RL. Some refiner plate segments may have sections 293 of the substrate 209 removed, particularly on the back surface 212, to reduce weight.

The front surface 219 further comprises an area 220 defined by the front surface 219 disposed between the narrow side 211, wide side 213, first lateral side 217 and second lateral side 218. In the embodiments depicted in FIGS. 2A-2D, the section of the area 220 disposed closer to the narrow side 211 has a plurality of alternating breaker bars 225 and grooves 227. "Breaker bars" 225 are sometimes known as "feeder bars" by persons having ordinary skill in the art. Breaker bars 225 break down larger pieces of feed material 247 before feeding the feed material 247 (FIG. 2B) further into the gap 449 for either further breaker bar encounters or for primary refining across the refining section 275. The breaker bars 225 engage the substrate 209 and adjacent breaker bars 225*z*, 22*zz* define a wide groove 227 there between. The breaker bars 225 are generally thicker, more widely spaced, and disposed closer to the center of rotation C than the refining bars 230. The breaker bars 225 and wide grooves 227 generally break down the lignocellulosic feed material 247 prior to feeding the lignocellulosic feed material 247 into the gap 449. When the area 220 comprises breaker bars $225_a$, $225_c$, the area 220 is known as a "breaker bar section" 234. When the area 220 comprises refining bars 230 and grooves 241, the area 220 is known as a "refining section" 275. In certain exemplary embodiments, a refiner plate segment 205 may comprise multiple refining sections 275. During operation, refining sections 275 on facing, oppositely disposed refiner plate segments 205 (FIGS. 2A and 2B), 205*z* (FIGS. 2C and 2D) transfer feed material 247 rapidly back and forth across the gap 449 to create a dense fiber pad having sufficient frictional and shear forces needed to defibrillate and thereby refine the feed material 247.

The refiner plate segments 205 may further comprise full-surface dams 257, subsurface dams 237, or both full-height dams 257 and subsurface dams 237. Both full-surface dams 257 and subsurface dams 237 are protrusions disposed within the refining grooves 241. Each type of dam 237, 257 is generally disposed perpendicular to the length of an adjacent refining bar 230 and may have an inclined leading face disposed closer to the narrow side 211 than a distally disposed trailing face. During operation, the full-surface dams 257 and subsurface dams 237 deflect feed material 247 flowing through the refining grooves 241 into the gap 449. A full-surface dam 257 has the same height as adjacent refining bars 230. A subsurface dam 237 is shorter than the adjacent refining bars 230.

The substrate 209 further comprises multiple water channels 250 disposed in the breaker bar section 234. An exemplary water channel 250 has a first end 251 disposed closer to the narrow side 211 than a second end 252. The second end 252 is disposed closer to the wide side 213. The exemplary water channel 250 is embedded within the substrate 209 and has a channel bottom 253 exposed to the gap 449 when the mechanical refiner 100 is operational. In certain exemplary embodiments (see FIGS. 6, 7A, 7B, 7C), the substrate 209 may surround the water channel 250 completely (see FIG. 6). The water channel 250 has a channel bottom 253 and distally disposed lateral sidewalls 254, 256 extending between the water channel first end 251 and the water channel second end 252.

Without being bounded by theory, it is believed that the water channel 250 provides an alternative path for the substantial amount of free water 245 that enters the mechanical disc refiner 100 as dilution water is released during the refining process. Additional free water 245 can come from seals in the form of condensate, for example. The channel bottom 253 may be flat to allow the free water 245 to flow along the radial length RL of the refiner plate segment 205 without being thrust into the gap 449 separating the opposing refiner plate segments (see 405 and 405*z*). Accordingly, the water channel's minimum length desirably allows a substantial part (e.g. greater than 50%) of the free water 245 to flow through the breaker bar section 234 without being deflected onto the opposite refiner plate segment 205*z*. Similarly, an exemplary water channel 250 may take a shape sufficient to allow a substantial part of the free water 245 to flow through the breaker bar section 234 without being deflected onto the opposite refiner plate segment 205*z*.

In other exemplary embodiments, two or more water channels 250 may be aligned radially in the variable substrate profile 210. The channel first end 251 may be disposed at the narrow side 211 of the refiner plate segment 205. In other exemplary embodiments, the channel second end 252 may extend to the border of the breaker bar section 234 and the refining section 275.

The water channel 250 preferably has a depth of between one-half of the variable substrate profile crest 239 to the full height of the variable substrate profile crest 239. In this manner, the water channel 250 can be said to have a comparative channel depth, wherein a height between the trough 235 and the radially adjacent crest 239 of the variable substrate profile 210 is a "full bump profile height," and wherein the comparative channel depth is between one half the full bump profile height and the full bump profile height.

The crest 239 is used to deflect the feed material 247 to the opposite refiner plate segment 205*z*. Ideally, the water channels 250 could have a width w of 2 millimeters ("mm") to 5 mm in order to prevent feed material 247, particularly lignocellulosic material from passing through the water channels 250 easily. It will be appreciated that small fine lignocellulosic particles may flow through the water channels 250.

In other exemplary embodiments), the channel bottom 253 may have a concave curve. In still other exemplary embodiments, two or more water channels 250 radially align in the variable substrate profile 210 (i.e. the water channels 250 are parallel to a radial line (see RL extending from the rotational axis C (FIG. 1B) to the wide side 213 of the refiner plate segment 205. In yet other exemplary embodiments (FIG. 4B), a channel bottom 253 may have a convex curve. Combinations of disclosed embodiments are considered to be within the scope of this disclosure.

Figure 2B:
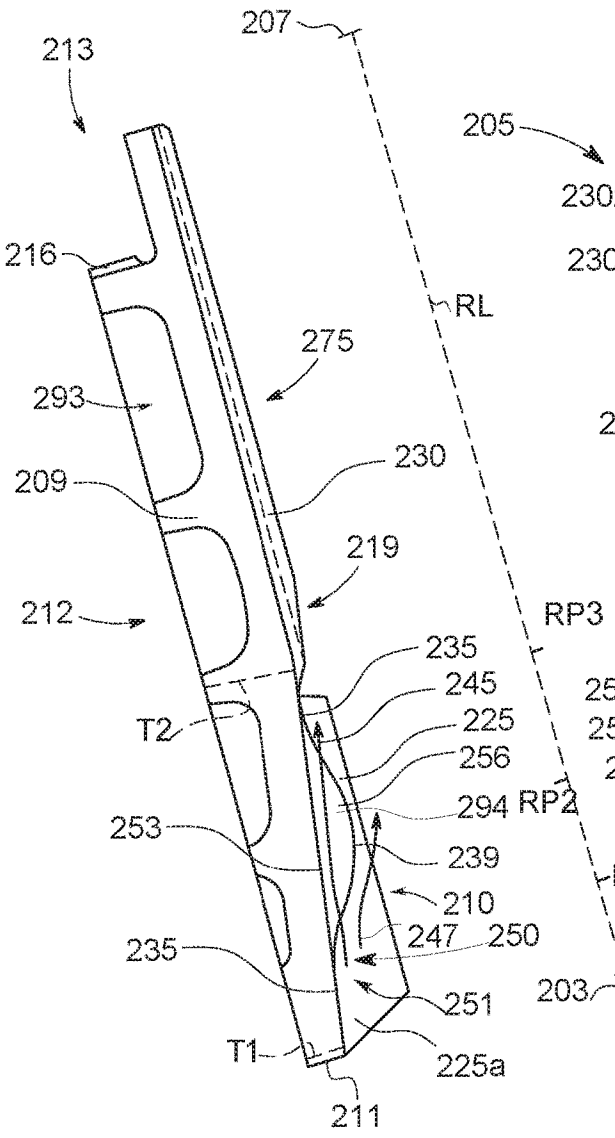
FIG. 2B is a cross-sectional profile view of the refiner plate segment depicted in FIG. 2A taken along the line A-A.

FIG. 2B is a cross-sectional profile of the exemplary refiner plate segment 205 of FIG. 2A taken along line A-A. FIG. 2B more clearly depicts the substrate 209 having a variable substrate profile 210 disposed between the narrow side 211 and the refining section 275 (see also FIG. 8). The variable substrate profile 210 includes a trough 235 (FIG. 2B) at a first radial position $RP_1$ on the front surface 219 and an adjacent crest 239 at a second radial position $RP_2$ on the front surface 219. The front surface 219 connects the trough 235 and the adjacent crest 239 in a sigmoid curve. The troughs 235 and adjacent crests 239 may be repeated along the length of the variable substrate profile 210. The variable substrate profile length VSPL is a subset of the radial length RL of the refiner plate segment 205.

In such exemplary embodiments, the repeated sigmoid curves define a wave along the variable substrate profile length. VSPL In this manner, the variable substrate profile 210 is configured to direct feed material 247 across the gap 449 to the opposite refiner plate segment 205*z*. If the opposite refiner plate segment 205*z* also has a complementary wave pattern, the opposite refiner plate segment 205*z* will direct the feed material 247 back to the first refiner plate segment 205 at a second radial position $RP_2$ disposed further from the narrow side 211 than the first radial position $RP_1$. The feed material 247 may be directed back and forth across the gap 449 at further radial positions disposed successively farther from the narrow side 211 (e.g. at third, fourth, fifth, six, etc. radial positions) depending upon the number of crests 239 and troughs 235 in the complementary wave patterns.

Figure 2C:
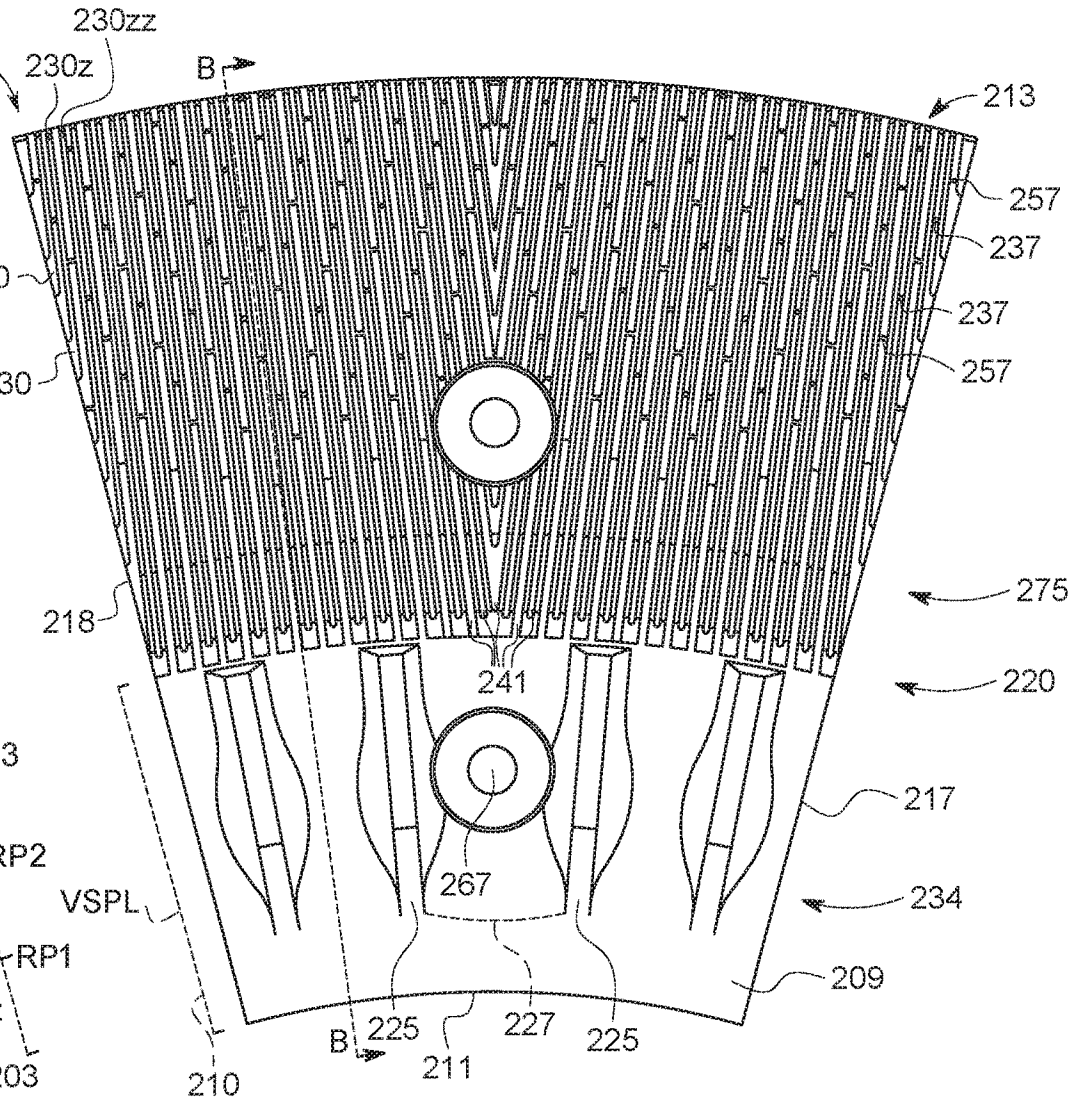
FIG. 2C is a facing view of an exemplary stator refiner plate segment.
Figure 2D:
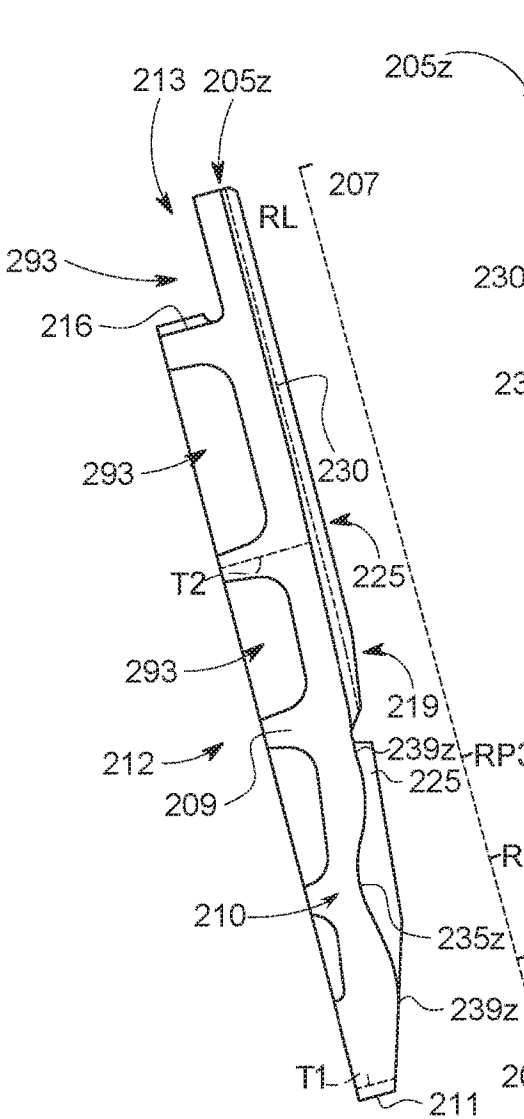
FIG. 2D is a cross-sectional profile view of the refiner plate segment depicted in FIG. 2C taken along the line B-B.
Figure 4B:
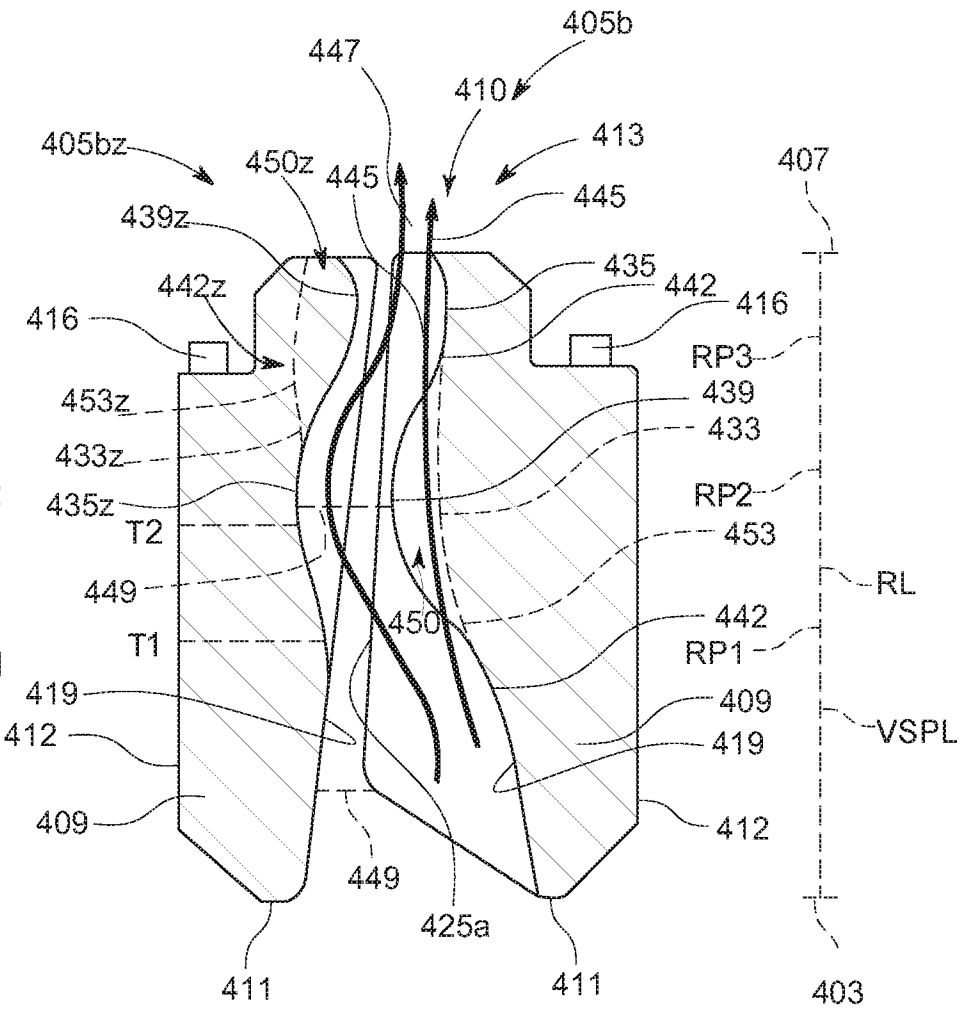
FIG. 4B is a cross sectional side view of an exemplary refiner plate segments having a curve-bottomed water channel with matching stator element.

For example, the feed material 247 crosses the gap 449 from the rotor refiner plate segment (see 205) depicted in FIG. 2B to an opposing stator refiner plate segment depicted in FIG. 2D (see 205*z*) between $RP_1$ and $RP_2$ (see also FIG. 4B). The feed material 247 flows back to the rotor between $RP_2$ and $RP_3$. Without being bounded by theory, it is believed that the transfer of feed material 247 back and forth across the gap 449 reduces the size of the feed material 247 more uniformly prior to introducing the feed material 247 to the primary refining section 275. Because the variable substrate profile 210 extends annularly around an assembled refiner assembly (see 101, 102), the radial positions $RP_1$, $RP_2$, $RP_3$, etc. are sequentially, but uniformly distributed around a circumference of the front surface 219. The distribution of the radial positions $RP_1$, $RP_2$, $RP_3$, etc. may allow for improved distribution of the feed material 247 at a more uniform size into the primary refining section 275 and thereby reduce the energy required to produce refined materials 147*z* at specified qualities. Furthermore, back flowing steam from the refining section 275 flows back through the sigmoid gap 449 toward the narrow side 211. This back flowing steam thermally softens the incoming feed material 247 and thereby "pretreats" the feed material prior to refining in the refining section 275. The more uniform size of the feed material 247, its improved distribution, also results in more evenly pretreated feed material 247 prior to refining. In this manner, the variable substrate profile 210 on at least one of the refiner plate segments 205 further facilitates backflow of a quantity of steam sufficient for thermally softening the feed material. Moreover, by adjusting the angle θ (FIG. 5) of the variable substrate profile 210 relative to the radial length RL, the variable substrate profile 210 may better control the angle at which the feed material enters the primary refining section 275.

FIG. 2C depicts an exemplary stator refiner plate segment 205*z* having a complementary variable substrate profile 210*z* to the rotor refiner plate segment 205 depicted in FIG. 2A. FIG. 2D is a cross-sectional side view of FIG. 2C taken along line B-B. A crest 239 at a second radial position $RP_2$ on the rotor refiner plate 205 corresponds to a trough 235*z* at substantially the same second radial position $RP_2$ on the stator refiner plate segment 205*z*. Likewise, a trough 235 at a first radial position $RP_3$ on the rotor refiner plate 205 corresponds to a crest 239 at substantially the same first radial position $RP_3$ on the stator refiner plate segment 205*z*. The same is true for the third radial position $RP_3$. A sigmoid curve connects the crests 239 and troughs 235 on the stator refiner plate segment 205*z* to form a variable substrate profile 210*z* having complementary wave pattern to the variable substrate profile 210 of the rotor refiner plate 205.

FIG. 2B and FIG. 2D are provided as an example. It will be understood that not every embodiment in accordance with the disclosure will have a trough 235 on the stator refiner plate 205 corresponding directly with the same radial position RP as a crest 239 at a given radial position RP on the rotor refiner plate 205. For the purposes of this disclosure, radial positions RP are defined relative to features on the rotor refiner plate segment 205 or first rotor refiner plate segment (see 405) unless otherwise specified. It will be understood that if the rotor refiner plate segment 205 has a trough 235 at the first radial position $RP_3$ and a crest 239 disposed radially outward at a second radial position $RP_2$, then the corresponding crest 239*z* on the stator refiner plate segment 205*z* may be disposed radially between the first radial position $RP_3$ and the second radial position $RP_2$. The same disclosure applies mutatis mutandis for subsequent radial positions (e.g. $RP_3$, $RP_4$, $RP_5$, $RP_6$, etc.).

Figure 3A:
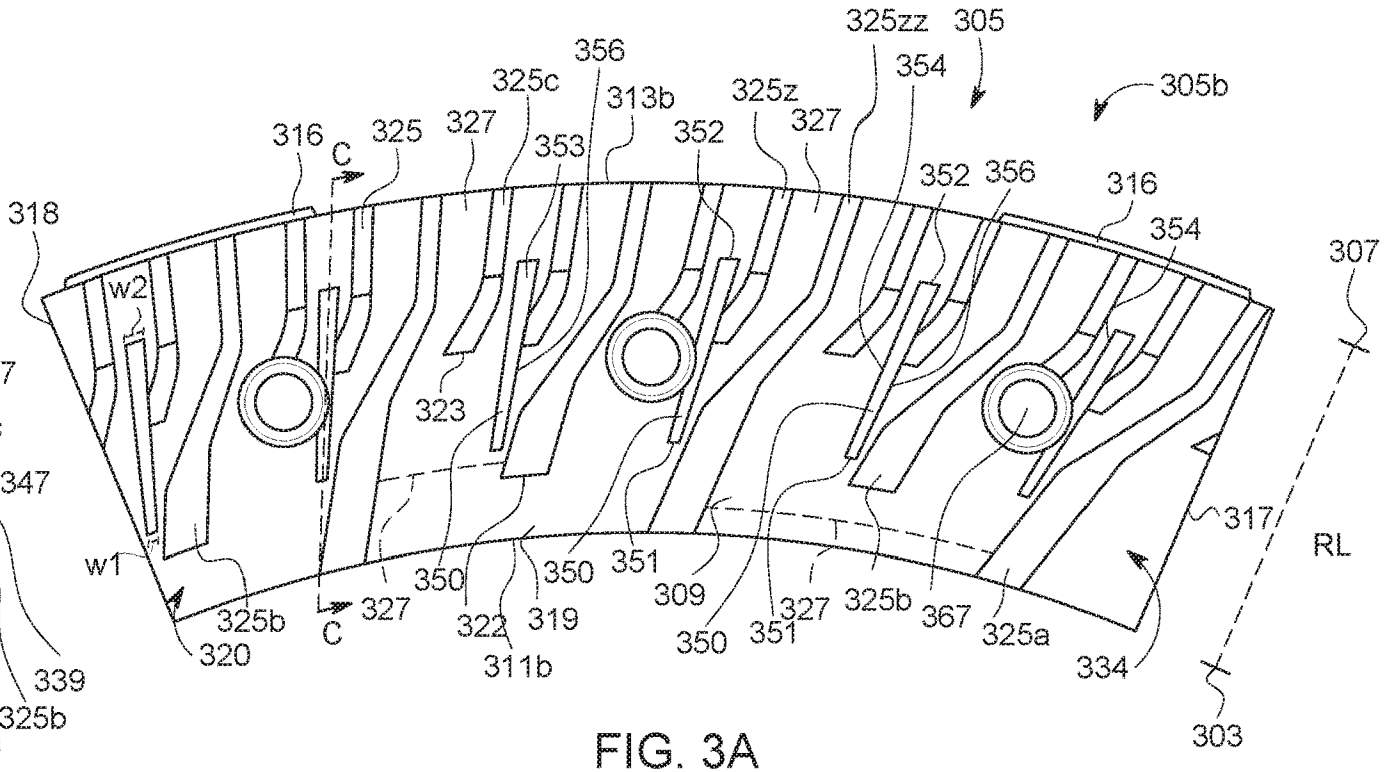
FIG. 3A is a top-down view of the facing surface of an exemplary refiner plate segment comprising multiple water channels disposed within the refiner plate segment substrate.
Figure 8:
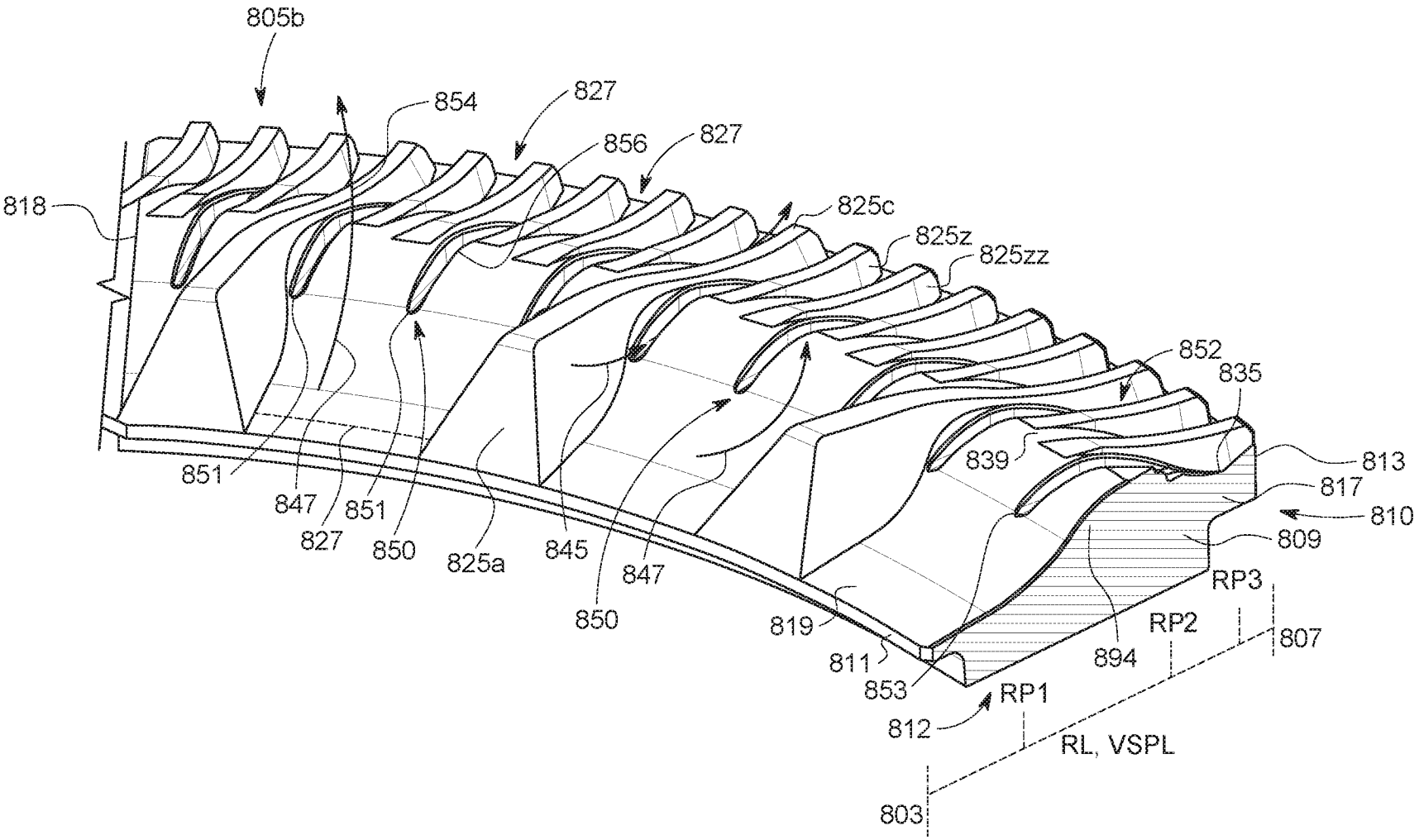
FIG. 8 is a perspective view of an exemplary refiner plate segment having multiple water channels.

FIG. 3A depicts an exemplary rotor refiner plate segment 305 in which the refiner plate segment 305 is breaker bar segment $\mathbf{305}_b$ (FIG. 3B) (see also FIG. 8). The breaker bar segment 305$_b$ comprises a substrate 309 having a radial length RL. The radial length RL has a radial length first end 303 and a radial length second end 307. The substrate 309 further comprises a narrow side 311 at the first end 303 of the radial length RL and a wide side 313$_b$ at the second end 307 of the radial length RL. The wide side 313$_b$ is therefore distally located from the narrow side 311$_b$ along the radial length RL and the wide side 313$_b$ is wider than the narrow side 311$_b$. Either the narrow side 311$_b$ or the wide side 313$_b$ may further comprise spacers 316 (see also 216) configured to position the refiner plate segment 305 against other refiner plate segments (see 305$_a$, FIG. 3B) or other piloting components in the mechanical refiner 100. Spacers 316 are generally considered part of the wide side 313$_b$.

Figure 3B:
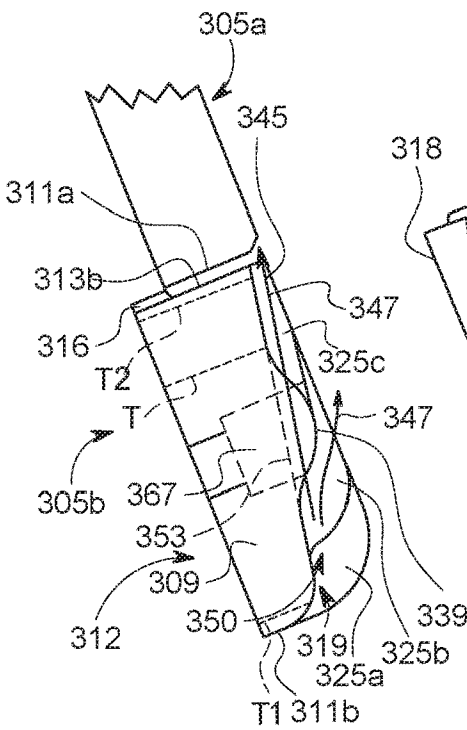
FIG. 3B is a side cross-sectional view of the exemplary refiner plate segment in FIG. 3A taken along the line C-C.

The substrate 309 of the refiner plate segment 305 further comprises a first lateral side 317 and a second lateral side 318 distally disposed from the first lateral side 317. The first lateral side 317 and the second lateral side 318 extend between the narrow side 311$_b$ and the wide side 313$_b$, typically along the radial length RL. FIG. 3B is a cross-sectional side view of FIG. 3A taken along line C-C. As FIG. 3B more clearly depicts, the substrate 309 has a back surface 312 oppositely disposed from a front surface 319 along a thickness T of the substrate 309. The back surface 312 and the front surface 319 extend between the wide side 313$_b$, narrow side 311$_b$, first lateral side 317, and the second lateral side 318. The thickness $T_1$ may be thinner at the narrow side 311$_b$ than the thickness $T_2$ at the wide side 313$_b$. The wide side 313$_b$ of the breaker bar segment 305$_b$ abuts the narrow side 311$_a$ of the refiner plate segment 305$_a$.

The front surface 319 further comprises an area 320 having a plurality of alternating breaker bars 325 and wide grooves 327. The breaker bars 325 engage the substrate 309 and adjacent breaker bars 325*z*, 325*zz* define a wide groove 327 between the adjacent breaker bars 325*z*, 325*zz*. The breaker bars 325 are generally thicker, more widely spaced, and disposed closer to the center of rotation than refining bars 230.

A refiner plate segment 305 may have several types of bars 230, 325 and grooves 241, 327. For example, when the refiner plate segment is a breaker bar segment 305$_b$, the bars 325 may include transverse bars 325$_a$ extending along the radial length RL of the breaker bar segment 305$_b$ from the narrow side 311 to the wide side 313.

The outer bars 325 and intermediate bars 325$_b$ increase the bar density on the front surface 319 as feed material 347 moves from the first end 303 to the second end 307 of the radial length RL and thereby break up the feed material 347 into smaller particles prior to injecting the feed material 347 radially outward into the gap 449 between outer refiner plate segments 305$_a$. Because the outer bars 325$_c$, intermediate bars 325$_b$, and transverse bars 325$_a$ are all disposed on a breaker bar segment 305$_b$, the outer bars 325$_c$, intermediate bars 325$_b$, and transverse bars 325$_a$ may be referred to generally as "breaker bars" 325.

An exemplary refiner plate segment 305 has multiple water channels 350. The number of water channels 350 are desirably sufficient to remove most of the free water 345 pushed across the gap 449 that would otherwise hit the opposite refiner plate segment 305*z*. The number of water channels 350 may ideally number at least as many as the transverse breaker bars 325$_a$ reaching towards the narrow side 311$_b$ of the breaker bar segment 305$_b$. The transverse bars 325$_a$ need not extend over the entire length of the breaker bar section 334, rather the transverse bars 325$_a$ need only be the longest bars on the breaker bar section 334. Ideally, the water channels 350 have a width w that increases slightly between the water channel's first end 351 and the water channel's second send 352. That is, the water channel 350 has a first width $w_1$ at the first end 351 and a second width $w_2$ at the second end 352. In this manner, the water channel 350 may prevent as many solid particles as possible from entering the water channel 350. It is not desirable to trap excessive feed material 347 in the water channel 350. In certain exemplary embodiments, the first width $w_1$ is zero mm (see FIG. 5).

It will be understood that the amount of exemplary water channels 350 may differ depending upon the type of the refiner plate segment 305 and the material for which the refiner plate segment is configured to grind. Moreover, the water channels' 350 exact location and dimensions may be varied to allow free water 345 to flow radially outward from the refiner plate segment 305 without deflecting an amount of free water 345 to the opposite refiner plate segment sufficient 305*z* to cause cavitation at a fixed radial position on the opposite refiner plate segment 305*z*.

FIG. 4B depicts opposing rotor breaker bar refiner plate segments 405$_b$, 405$_b$*z*. In the depicted embodiment, the water channels 450 on the first rotor breaker bar segment 405$_b$ have a convexly curved bottom 453. That is, the water channels on the first rotor breaker bar segment 405$_b$ have a water channel trough 442 at a first radial position $RP_1$ and a water channel crest 433 adjacent to the water channel trough 442 and radially outward of the water channel trough 442 at a second radial position $RP_2$, wherein the water channel bottom 453 connects the water channel trough 442 to the water channel crest 433 in a convex curve. Similarly, a second water channel trough 442 is disposed at a third radial position $RP_3$ radially outward from the water channel crest 433 at the second radial position $RP_2$. The water channel bottom 453 similarly connects the crest 433 at the second radial position $RP_2$ to the trough 442 at the third radial position $RP_3$ in a convex curve. However, the water channel crest 433 is shorter than the variable substrate crest 439 on the same refiner plate segment 405$_b$. As a result, the water channel crests 433 are less likely to deflect free water 445 to a fixed radial position on the opposite refiner plate segment 405*z*, thereby avoiding the cavitation problems that affected prior variable substrate profile designs.

Similarly, FIG. 4B illustrates a second breaker bar segment 405$_b$*z* having water channels 450*z* with a concavely curved bottom 453*z*. That is, the water channels 450*z* on the second rotor breaker bar segment 405$_b$*z* have a water channel trough 442*z* and a water channel crest 433*z* adjacent to the water channel trough 442*z*, wherein the water channel bottom 453*z* connects the water channel trough 442*z* to the water channel crest 433*z* in a concave curve.

FIG. 4B is provided as an example. It will be understood that not every embodiment in accordance with the disclosure will have a water channel trough 442 on the second refiner plate segment 405*z* corresponding directly with the same radial position RP as a water channel crest 433 at a given radial position RP on the first refiner plate segment 405. It will be understood that if the first refiner plate segment 405 has a water channel trough 442 at the first radial position $RP_1$ and a water channel crest 433 disposed radially outward of the water channel trough 442 at a second radial position $RP_2$, then the corresponding water channel crest 233*z* on the opposing refiner plate segment 405*z* may be disposed radially between the first radial position $RP_1$ and the second radial position $RP_2$ relative to the first refiner plate segment 405. The same disclosure applies mutatis mutandis for subsequent radial positions (e.g. $RP_3$, $RP_4$, $RP_5$, $RP_6$, etc.).

Furthermore, even though FIG. 4B depicts a convex water channel bottom 453 on the first refiner plate segment 405 and a concave water channel bottom 453*z* on the second (opposing) refiner plate segment 405*z*, it will be understood that the curved bottoms 453, 453*z* may be switched in other exemplary embodiments.

Figure 4A:
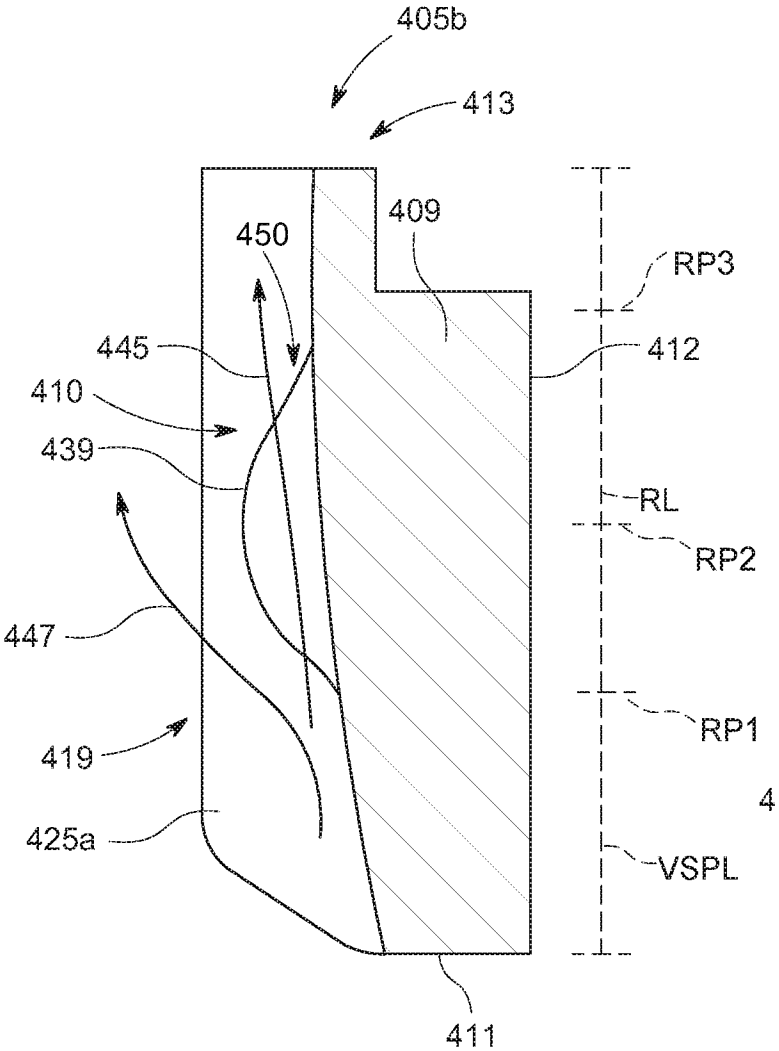
FIG. 4A is a cross sectional side view of an exemplary refiner plate segment having a flat-bottomed water channel.

FIG. 4A shows a flat water channel 450 similar to the water channel depicted in FIG. 3B. FIGS. 4A and 4B depict breaker bar segments $\mathbf{405}_b$ configured for use in a counter-rotating mechanical disc refiner (see 100). It will be understood that exemplary refiner plate segments 405 may have combinations or variations of the water channels 450 described herein. The flat water channel trough 450 lacks a water channel trough 442 and a water channel crest 433. FIG. 4A more clearly shows the path of free water 445 through the water channel 450. Whereas the free water 445 flows primarily across the refiner plate segment 405 along the radial length RL, the variable substrate profile 410 directs the feed material 447 into the gap 449 between the opposing refiner plate segments 405, 405*z*.

Because the breaker bar segment $\mathbf{405}_b$ does not have a refining section 275, the variable substrate profile 410 can extend the radial length RL of the breaker bar segment $\mathbf{405}_b$. In other exemplary embodiments, the variable substrate profile 410 may extend less than the radial length RL of the breaker bar segment $\mathbf{405}_b$. As described with reference to FIG. 2B, the front surface 419 of the refiner plate segment 405 repeatedly connects alternating troughs 435 and crest 439 with sigmoid curves to define a wave along the variable substrate profile's length VSPL. The sigmoid curve rising from a trough 435 can direct incoming feed material 447 across the gap 449 toward the opposite refiner plate segment 405*z*. The opposite refiner plate segment 405*z* has a complementary wave pattern, which directs the feed material 447 back to the first refiner plate segment 405 at a second radial position $RP_2$ disposed further from the narrow side 411 than the first radial position $RP_1$. The feed material 447 may be directed back and forth across the gap 449 at further radial positions disposed successively farther from the narrow side 419 (e.g. at third, fourth, fifth, six, etc. radial positions) depending upon the number of crests 439 and troughs 435 in the complementary wave patterns. It will be appreciated that in other exemplary embodiments, the wavelength may increase or decrease along the variable substrate profile length VSPL. It will further be understood that the amplitude of a wavelength may vary depending upon the type of feed material 447 the refiner plate segment 405 is configured to process.

Figure 5:
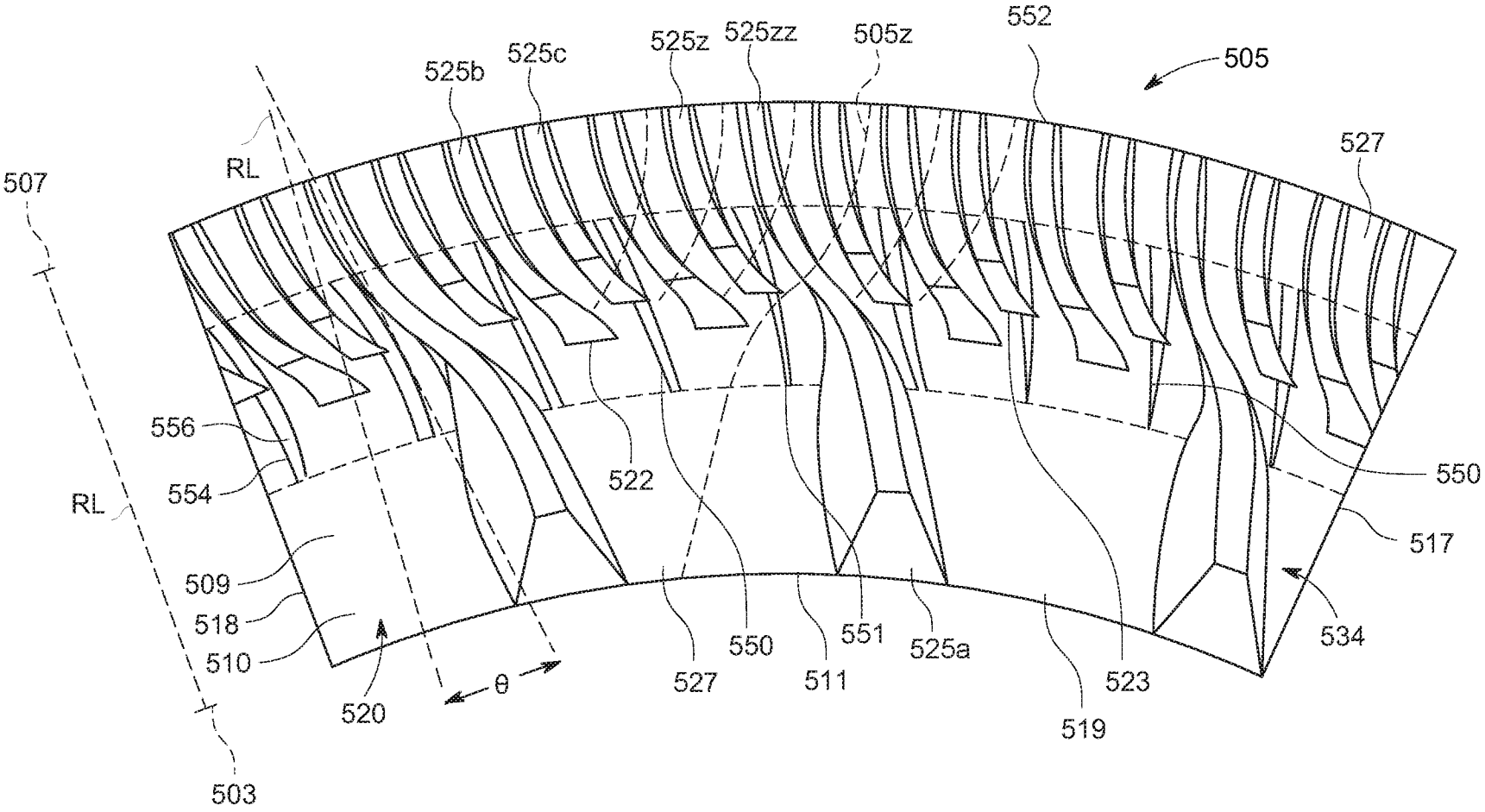
FIG. 5 is a top down view of overlaid exemplary refiner plate segments having multiple water channels disposed at an angle relative to the radial length of the refiner plate segments.

FIG. 5 depicts exemplary rotor breaker bar segments $\mathbf{505}_b$ for a mechanical refiner 100. The depicted breaker bar segments $\mathbf{505}_b$ have curved breaker bars 525 and water channels 550. The water channels 550 may be disposed at an angle Θ relative to the radial length RL of the refiner plate segment 505—including lateral angles, vertical angles, and combinations thereof. FIG. 5 also depicts the opposite refiner plate segment 505*z* in dotted lines. It will be understood that the breaker bars 525 may have any feeding angle and holding angle. It will further be understood that the refining bars 230 may have any feeding angle and holding angle. Exemplary pairs of complementary refiner plate segments (505, 505*z*) may have a greater or lesser frequency of wavelengths in the variable substrate profile 410 than the depicted embodiment.

Although generally depicted linearly, it will be understood that exemplary water channels 550 may be convexly curved, concavely curved, or have a sigmoid curve along the variable substrate profile length VSPL, including in a lateral direction, vertical direction, or a combination thereof.

Figure 6:
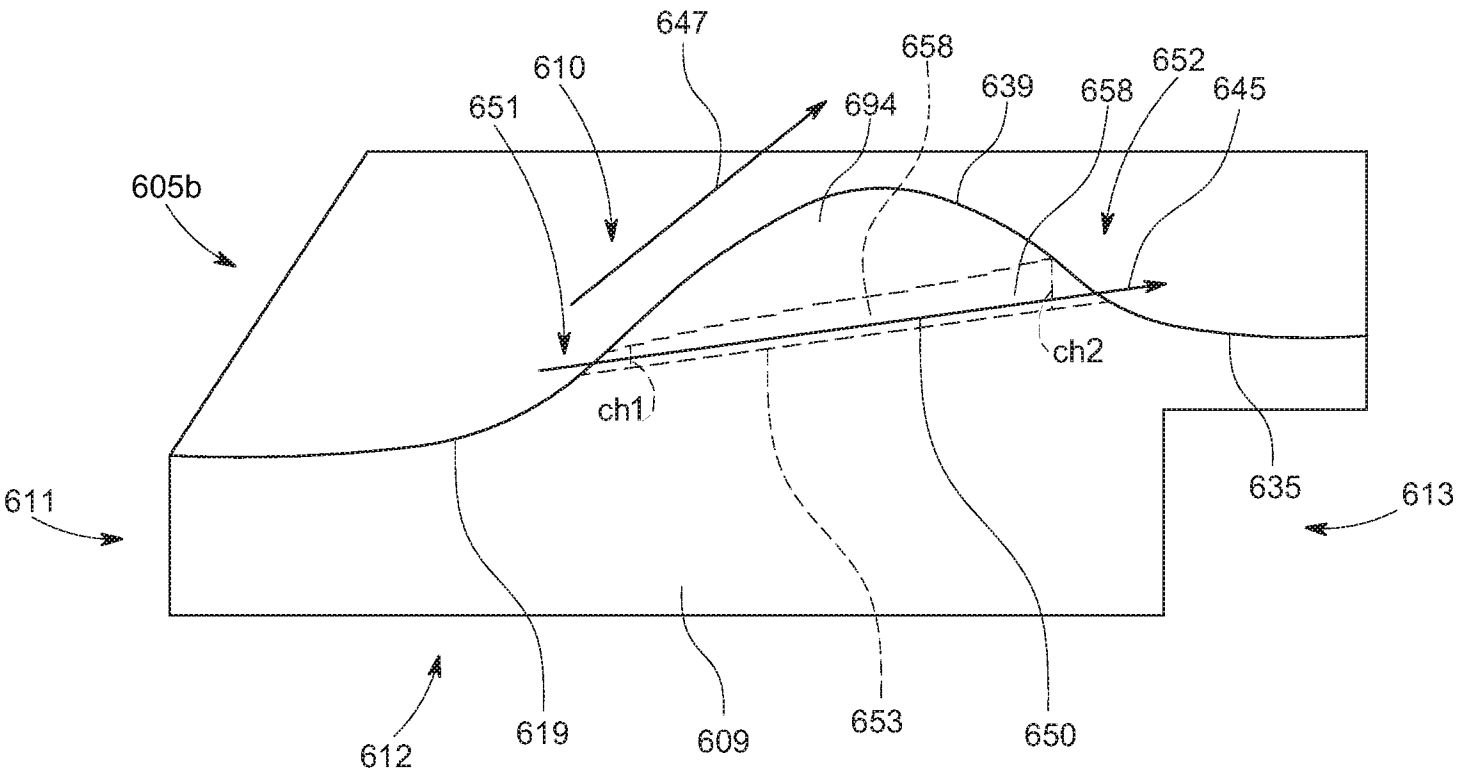
FIG. 6 is a cross sectional view of an exemplary refiner plate segment having a water channel disposed within the refiner plate substrate such that only the ends of the water channel are exposed to the refining environment.

FIG. 6 depicts an exemplary water channel 650 disposed entirely within the substrate 609 such that only the water channel first end 651 and second end 652 are exposed to the process. As a result, the substrate 609 further defines a channel top 658. The water channel second end 652 may have a height $ch_2$ that is greater than the height $ch_1$ at the water channel first end 651. In other exemplary embodiments, the water channel height may be substantially constant. It is contemplated that by manufacturing the first end 651 of the water channel 650 to be smaller than the second end 652 of the water channel, the water channel 650 will be less likely to receive feed material 647 and more likely to allow the free water 645 to flow through the water channel 650 without traversing the gap 449.

Figure 7A:
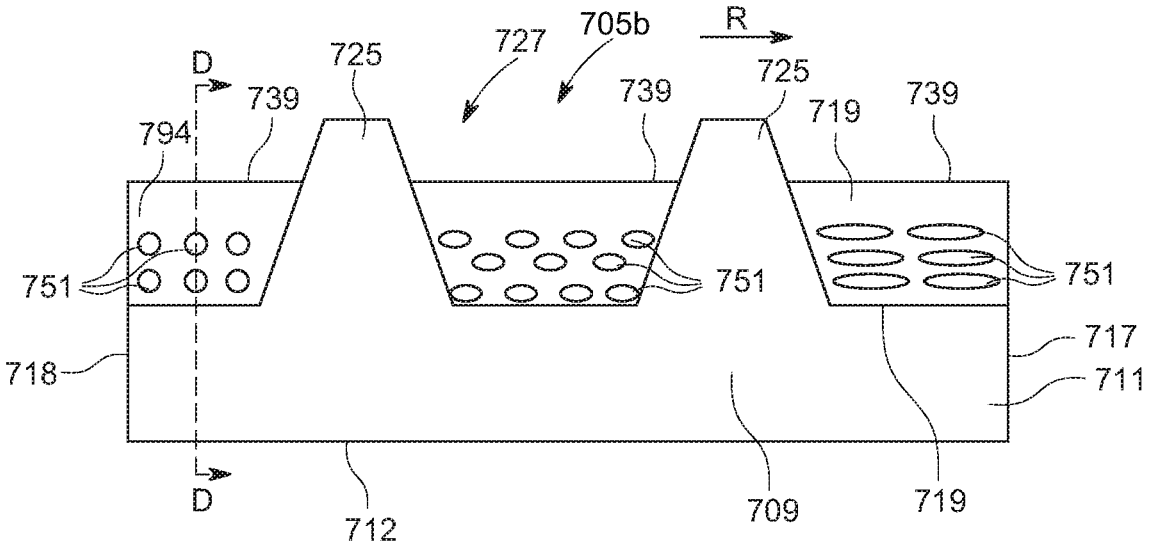
FIG. 7A is a facing view of the narrow side of an exemplary refiner plate segment comprising multiple water channels disposed within the refiner plate substrate.

FIG. 7A is a facing view of the narrow side 711 and first ends 751 of multiple water channels 750 disposed within the substrate 709 having the first ends 751 and second ends 752 (FIG. 7C) exposed to the process. The first end 751 may have a shape selected from any shape, including a circle, oval, quadrilateral, polygon, or rounded rectangle. The multiple water channels 750 may be disposed within the portion of the substrate 709 defining a wavelength between two adjacent troughs 635, 635*z*. The multiple water channels 750 may be randomly arranged within the substrate 709 provided that the water channel first end 751 is disposed closer to the narrow end 711 than the second end 752. Likewise, in other exemplary embodiments, the multiple water channels 750 may be arrayed in an ordered fashion. In certain exemplary embodiments, each of the multiple water channels 750 extend through the substrate 709 having one water channel first end 751 aligning with one water channel second end 752 (see FIG. 2A).

Figure 7B:
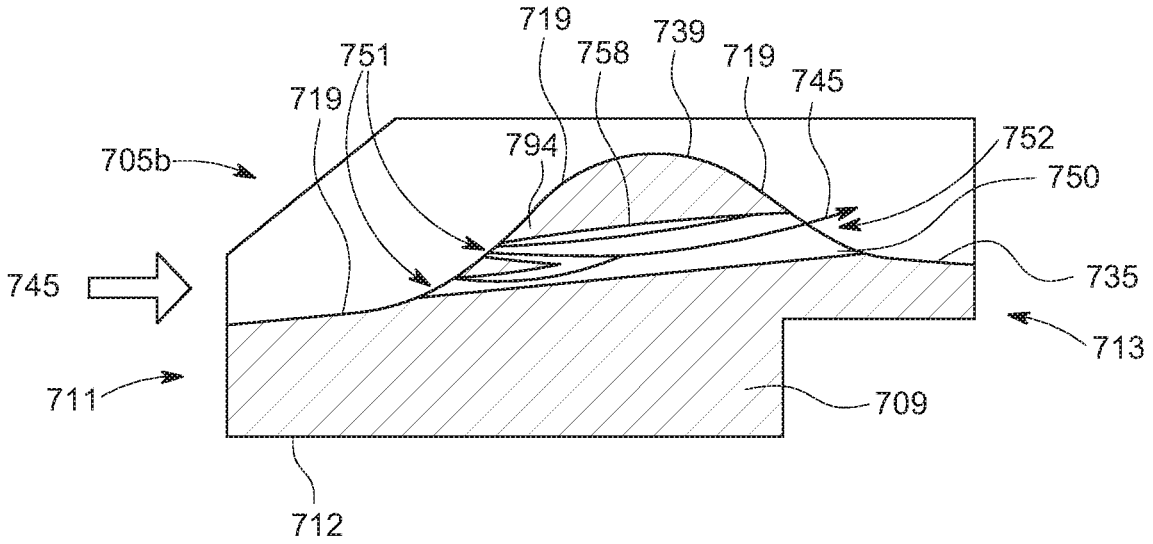
FIG. 7B is a side cross-sectional view of the exemplary refiner plate segment in FIG. 7A taken along the line D-D.

FIG. 7B is a cross-sectional view of FIG. 7A taken along line D-D. FIG. 7B depicts another exemplary embodiment in which a water channel 750 has multiple first ends 751, 751*z* and fewer second ends 752 than the multiple first ends 751, 751*z*. In the depicted embodiment, the multiple first ends 751 are smaller than the second end 752, thereby desirably preventing lignocellulosic feed material 747 from entering the water channel 750 while permitting free water 754 to enter into the water channel 750.

Figure 7C:
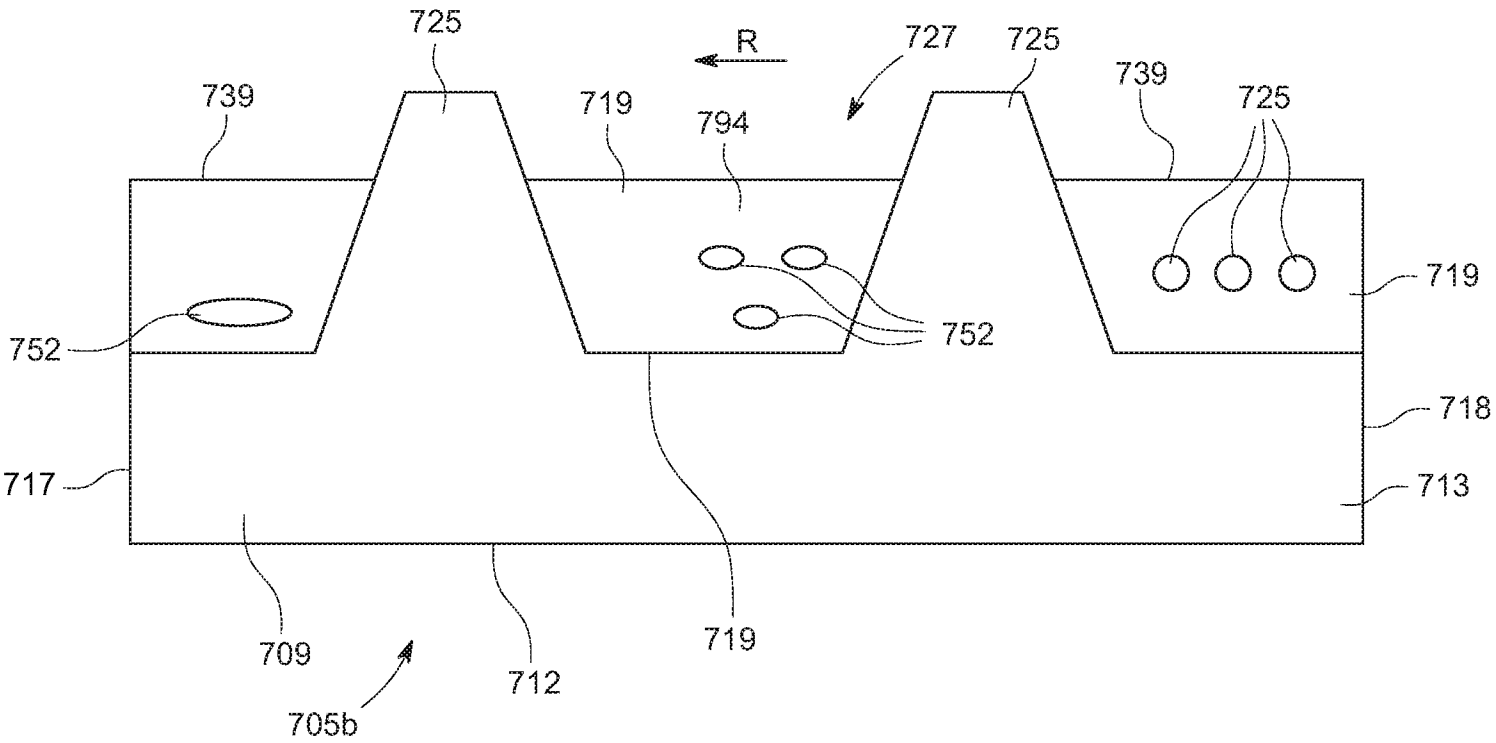
FIG. 7C is a facing view of the wide side of an exemplary refiner plate segment comprising multiple water channels disposed within the refiner plate substrate. In the depicted exemplary embodiment, the water channels have fewer second ends than first ends.

FIG. 7C shows exemplary second ends 752 of the water channels 750. The second ends 752 of the water channels 750 may be different shapes than the first ends 751 of the water channels 750 regardless of whether the water channels 750 consolidate along the radial length RL of the substrate 709. In embodiments wherein a single water channel first end 751 aligns with a single water channel second end 752, a manufacturer may create the water channel 750 by drilling into the substrate 709 of the variable substrate profile 710. Alternatively, a manufacturer may choose to use an additive manufacturing technique, such as a three-dimensional ("3D") printing technique to create water channels 750. It is believed that additive manufacturing may be particularly desirable to create water channels 750 enclosed by the substrate 709 as exemplified in FIGS. 6, 7A, 7B, and 7C.

FIG. 8 is a perspective view of an exemplary breaker bar segment $\mathbf{805}_b$. From this perspective, one can more clearly see that the variable substrate profile 810 flings feed material 847 away from the front surface 819 towards an opposing refiner plate segment $\mathbf{405}_b z$ (FIG. 4B). The water channels 850 by contrast allow free water 845 to pass through the variable substrate profile 810 without crossing the gap 449 towards the opposing refiner plate segment $\mathbf{405}_b z$.

Applicable three-dimensional printing techniques include selective laser sintering ("SLS"), direct metal laser sintering ("DMLS") electron beam melting ("EBM"), binder jetting ("BJ"), and material jetting ("MJ")/wax casting.

In the SLS technique, manufactures aim a laser (typically a pulse laser) at a source of sinter powered material to selectively fuse small particles of metal into a mass that has the desired cross-sectional shape of the finished product. The sinter powdered material may be a single-component powder or a multi-component powder comprising a polymer. When a component is a polymer, the laser typically melts the polymer to glue the surrounding solid components together. By adding additional layers of sinter powered material and repeating the selective fusing process to build subsequent cross-sectional layers of the desired product, manufactures may use the SLS technique to manufacture either a completed refiner plate segment as described herein, or a mold or mold component for casting an exemplary refiner plate segment. Upon completion of the building process, manufactures may use a vacuum to remove excess sinter powder.

The DMLS technique resembles the SLS technique except that the powder is the metal or metal alloy of the desired product and the laser fully melts the powder rather than merely melting a binding agent. That is, the laser selectively melts the metal powder to construct the desired product over time.

The EBM technique is similar to the DMLS process, except that manufactures use an electron beam rather than a laser as the primary energy source.

In the BJ technique, an inkjet print head moves across a powder bed and selectively deposits an adhesive or other binder into the powder bed in a cross-sectional shape of the finished product. After depositing a layer of binder, an additional layer of power is deposited and the print head continues to print the next cross-sectional shape. In this way, manufactures can build a three-dimensional product from the powder bed. It is contemplated that manufactures may use the BJ method to print a sand mold having solid tendrils where the exemplary water channels 750 would be on the finished refiner plate segment 705.

Manufactures may then introduce molten metal into the sand mold to create an exemplary refiner plate segment 705. Once cooled, the manufactures may break apart the sand mold physical or chemically to expose the refiner plate segment 705. If any remaining sand occupies the subsurface water channel 750, Manufactures may chemically dissolve the binder and blow or vacuum the resulting free sand.

It will be understood that combinations of embodiments disclosed herein, including combinations of the embodiments described in reference to FIGS. 2A, 2B, 2C, 2D, 3A, 3B, 4A, 4B, 5, 6A, 6B, 7A, 7B, and 8 are considered to be within the scope of this disclosure.

An exemplary method of manufacturing a refiner plate segment having a water channel disposed between a narrow side and a refining section of the refiner plate having a variable substrate profile, comprises: using an additive manufacturing technique to create a water channel in the variable substrate profile, the water channel having a first end disposed closer to the narrow side than a second end, the water channel being disposed in the substrate below the front surface. An exemplary method of manufacturing may further comprise using the additive manufacturing technique to create the water channel within the substrate without drilling. In the exemplary manufacturing method, the additive manufacturing technique may be selected from the group consisting of: selective laser sintering, selective laser melting, electron beam melting, binder jetting, and material jetting.

A further exemplary method of manufacturing a refining plate segment having a water channel disposed between a narrow side and a refining section of the refiner plate having a variable substrate profile, comprises: using an additive manufacturing process to print a sand mold for a refiner plate segment, wherein the sand mold has areas defining a void in the shape of a refiner plate segment having a variable substrate profile, and wherein the sand mold has a protrusion extending into an area of the void that will define the variable substrate, the protrusion being configured to define a water channel when the refining plate segment is cast in the mold; and removing the protrusion from a cast refiner plate segment to define the water channel.

An exemplary refiner plate segment for a mechanical refiner comprises: a substrate having: a radial length, a narrow side disposed at a first end of the radial length, a wide side disposed at a second end of the radial length, the wide side located radially distant from the narrow side along the radial length, the wide side being wider than the narrow side, a first lateral side extending between the narrow side and the wide side along the radial length, a second lateral side extending between the narrow side and the wide side along the radial length, the second lateral side being distally disposed from the first lateral side, and a back face oppositely disposed from a front face along a thickness, the back face and the front face extending between the wide side, narrow side, first lateral side, and second lateral side, wherein the front face further comprises an area having a plurality of alternating breaker bars and wide grooves, wherein the breaker bars engage the substrate and wherein adjacent breaker bars and the substrate define a wide groove between the adjacent breaker bars, wherein the substrate further comprises a variable substrate profile disposed between the wide side and the narrow side, the variable substrate profile comprising: a trough at a first radial position on the front face, an adjacent crest at a second radial position on the front face, wherein the front face connects the trough and the adjacent crest, and wherein the substrate further comprises a water channel having a first end disposed closer to the narrow side than a second end.

An exemplary embodiment may further comprise a comparative channel depth, wherein a height between the trough and the adjacent crest of the variable substrate profile is a "full bump profile height," and wherein the comparative channel depth is between one half the full bump profile height and the full bump profile height.

In an exemplary embodiment, the refiner plate segment may have a first end of the water channel that has a first end width of between 2 millimeters and 5 millimeters.

In an exemplary embodiment, the refiner plate segment may have a first end of the water channel having a first width, the second end of the water channel having a second width, wherein the second width is greater than the first width. In an exemplary embodiment, the substrate sidewalls extend linearly between the first end and the second end. In yet another exemplary embodiment, the first end of the water channel has a first height, the second end of the water channel has a second height, wherein the second height is greater than the first height.

The refiner plate segment may have one or more water channels disposed within the substrate. The first end of the water channel may have a shape selected from the group consisting of: a circle, an oval, a polygon, a quadrilateral, and a rounded rectangle. Exemplary water channels may fuse along the radial length of the refiner plate segment such that the fused water channel has more first ends than second ends.

A refiner plate segment having an exemplary water channel may have a water channel that further comprises a water channel trough at a first radial position on a channel bottom and an adjacent water channel crest at a second radial position on the channel bottom, wherein the channel bottom connects the water channel trough and the adjacent water channel crest in a straight line, or in a concave, a convex, or a sigmoid curve.

The variable substrate profile of exemplary refiner plate segments may form the shape of a transverse wave. In still other exemplary embodiments, water channel bottom forms the shape of a transverse wave.

An exemplary water channel further may further comprise multiple water channel troughs alternatingly disposed between multiple water channel crests, each water channel crest being adjacent to at least one water channel trough.

An exemplary refiner plate segment having a variable substrate profile may have a variable substrate profile that further comprises multiple troughs alternatingly disposed between multiple crests, each crest being adjacent to at least one trough.

An exemplary water channel is defined by the substrate. The substrate can define the water channel with a channel bottom and distally disposed substrate sidewalls extending between the water channel first end and the water channel second end, the channel bottom being disposed within the substrate below the front face of the refiner plate segment.

An exemplary mechanical refiner comprises: a first refining assembly having a center of rotation at an axis and being configured to rotate around the axis, and a second refining assembly facing the first refining assembly, wherein the first refining assembly and the second refining assembly each comprise: a backing structure and a plurality of refiner plate segments annularly arranged and fixedly engaged to the backing structure, the refiner plate segments having: a substrate comprising: a radial length, a narrow side disposed at a first end of the radial length, a wide side disposed at a second end of the radial length, the wide side located radially distant from the narrow side along the radial length, the wide side being wider than the narrow side, a first lateral side extending between the narrow side and the wide side along the radial length, a second lateral side extending between the narrow side and the wide side along the radial length, the second lateral side being distally disposed from the first lateral side, a back surface oppositely disposed from a front surface, the back surface and the front surface extending between the wide side, narrow side, first lateral side, and second lateral side, the back surface disposed on the backing structure, wherein the front surface further comprises an area having a plurality of alternating refining bars and grooves, wherein the refining bars engage the substrate and wherein adjacent refining bars and the substrate define a groove between the adjacent refining bars, wherein the area of alternating refining bars and grooves is known as "a refining section", wherein the substrate further comprises a variable substrate profile disposed between the refining section and the narrow side, the variable substrate profile comprising: a trough at a first radial position on the front surface, an adjacent crest at a second radial position on the front surface, wherein the front surface connects the trough and the adjacent crest, and wherein the substrate further comprises a water channel having a first end disposed closer to the narrow side than a second end.

An exemplary mechanical refiner may be selected from the group consisting of a rotor-stator refiner, counter-rotating refiner, double disc refiner, disc-conical refiner, and conical refiner.

A further exemplary refiner plate segment for a mechanical refiner comprises: a substrate having: a radial length, a narrow side disposed at a first end of the radial length; a wide side disposed at a second end of the radial length, the wide side located radially distant from the narrow side along the radial length, the wide side being wider than the narrow side; a first lateral side extending between the narrow side and the wide side along the radial length; a second lateral side extending between the narrow side and the wide side along the radial length, the second lateral side being distally disposed from the first lateral side; and a back surface separated from a front surface by a thickness, the back surface and the front surface extending between the wide side, narrow side, first lateral side, and second lateral side, wherein the front surface further comprises an area having a plurality of alternating refining bars and grooves, wherein the refining bars engage the substrate and wherein adjacent refining bars and the substrate define a groove between the adjacent refining bars, wherein the area of alternating refining bars and grooves is known as "a refining section", wherein the substrate further comprises a variable substrate profile disposed between the refining section and the narrow side, the variable substrate profile comprising: a trough at a first radial position on the front surface, an adjacent crest at a second radial position on the front surface, wherein the front surface connects the trough and the adjacent crest in a sigmoid curve, and wherein the substrate further comprises a water channel having a first end disposed closer to the narrow side than a second end, the second end being disposed closer to the wide side, the substrate defining the water channel with a channel bottom and distally disposed substrate sidewalls extending between the water channel first end and the water channel second end, the water channel being disposed within the substrate below the front surface.

Such an exemplary refiner plate segment may further comprise breaker bars disposed between the narrow side and the refining section, wherein the substrate further comprises multiple water channels.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the invention.

What is claimed is:

1. A refiner plate segment for a mechanical refiner comprising:

a substrate having:

a radial length;

a narrow side disposed at a first end of the radial length;

a wide side disposed at a second end of the radial length, the wide side located radially distant from the narrow side along the radial length, the wide side being wider than the narrow side;

a first lateral side extending between the narrow side and the wide side along the radial length;

a second lateral side extending between the narrow side and the wide side along the radial length, the second lateral side being distally disposed from the first lateral side; and a back face oppositely disposed from a front face along a thickness, the back face and the front face extending between the wide side, narrow side, first lateral side, and second lateral side, wherein the front face further comprises an area having a plurality of alternating breaker bars and wide grooves, wherein the breaker bars engage the substrate and wherein adjacent breaker bars and the substrate define a wide groove between the adjacent breaker bars, wherein the substrate further comprises a variable substrate profile disposed between the wide side and the narrow side, the variable substrate profile comprising:

a trough at a first radial position on the front face, an adjacent crest at a second radial position on the front face, wherein the front face connects the trough and the adjacent crest, and wherein the substrate further comprises a water channel extending through the adjacent crest and being disposed in the substrate below the front surface, the water channel having a first end disposed closer to the narrow side than a second end.

2. The refiner plate segment of claim 1, wherein the water channel further comprises a comparative channel depth, wherein a height between the trough and the adjacent crest of the variable substrate profile is a "full bump profile height," and wherein the comparative channel depth is between one half the full bump profile height and the full bump profile height.

3. The refiner plate segment of claim 1, wherein the first end of the water channel has a first end width of between 2 millimeters and 5 millimeters.

4. The refiner plate segment of claim 1, wherein the breaker bars further comprise transverse breaker bars, and wherein multiple water channels number at least as many as the transverse breaker bars.

5. The refiner plate segment of claim 1, wherein the first end of the water channel has a first width, the second end of the water channel has a second width, and wherein the second width is greater than the first width.

6. The refiner plate segment of claim 1, wherein substrate sidewalls extend linearly between the first end and the second end.

7. The refiner plate segment of claim 1, wherein the first end of the water channel has a first height, the second end of the water channel has a second height, and wherein the second height is greater than the first height.

8. The refiner plate segment of claim 1, wherein the water channel is disposed within the substrate.

9. The refiner plate segment of claim 8 further comprising multiple water channels disposed within the substrate.

10. The refiner plate segment of claim 8, wherein the first end of the water channel has a shape selected from the group consisting of: a circle, an oval, a polygon, a quadrilateral, and a rounded rectangle.

11. The refiner plate segment of claim 9, wherein two or more water channels of the multiple water channels fuse along the radial length of the refiner plate segment such that a fused water channel has more first ends than second ends.

12. The refiner plate segment of claim 1, wherein the water channel further comprises a water channel trough at the first radial position on a channel bottom and an adjacent water channel crest at the second radial position on the channel bottom, wherein the channel bottom connects the water channel trough and the adjacent water channel crest in a straight line, or in a concave, a convex, or a sigmoid curve.

13. The refiner plate segment of claim 12, wherein the water channel further comprises a comparative crest depth defined by the difference between the adjacent water channel crest and the adjacent crest of the variable substrate profile, wherein a height between the trough and the adjacent crest of the variable substrate profile is a "full bump profile height," and wherein the comparative channel depth is less than or equal to the full bump profile height.

14. The refiner plate segment of claim 1, wherein the variable substrate profile forms the shape of a transverse wave and wherein the water channel bottom forms the shape of a transverse wave.

15. The refiner plate segment of claim 1, wherein the substrate defines the water channel with a channel bottom and distally disposed substrate sidewalls extending between the water channel first end and the water channel second end, the channel bottom being disposed within the substrate below the front face.

16. A mechanical refiner comprising:

a first refining assembly having a center of rotation at an axis and being configured to rotate around the axis; and a second refining assembly facing the first refining assembly, wherein the first refining assembly and the second refining assembly each comprise:

a backing structure and a plurality of refiner plate segments annularly arranged and fixedly engaged to the backing structure, the refiner plate segments having:

a substrate comprising:

a radial length, a narrow side disposed at a first end of the radial length, a wide side disposed at a second end of the radial length, the wide side located radially distant from the narrow side along the radial length, the wide side being wider than the narrow side, a first lateral side extending between the narrow side and the wide side along the radial length, a second lateral side extending between the narrow side and the wide side along the radial length, the second lateral side being distally disposed from the first lateral side, a back surface oppositely disposed from a front surface, the back surface and the front surface extending between the wide side, narrow side, first lateral side, and second lateral side, the back surface disposed on the backing structure, wherein the front surface further comprises an area having a plurality of alternating refining bars and grooves, wherein the refining bars engage the substrate and wherein adjacent refining bars and the substrate define a groove between the adjacent refining bars, wherein the area of alternating refining bars and grooves is known as "a refining section", wherein the substrate further comprises a variable substrate profile disposed between the refining section and the narrow side, the variable substrate profile comprising:

a trough at a first radial position on the front surface, an adjacent crest at a second radial position on the front surface, wherein the front surface connects the trough and the adjacent crest, and wherein the substrate further comprises a water channel extending through the adjacent crest and being disposed in the substrate below the front surface, the water channel having a first end disposed closer to the narrow side than a second end.

17. The mechanical refiner of claim 16, wherein the mechanical refiner is selected from the group consisting of a rotor-stator refiner, counter-rotating refiner, double disc refiner, disc-conical refiner, and conical refiner.

18. The refiner plate segment of claim 16, wherein the substrate defines the water channel with a channel bottom and distally disposed substrate sidewalls extending between the water channel first end and the water channel second end, the channel bottom being disposed within the substrate below the front face.

19. A refiner plate segment for a mechanical refiner comprising:

a substrate having:

a radial length;

a narrow side disposed at a first end of the radial length;

a wide side disposed at a second end of the radial length, the wide side located radially distant from the narrow side along the radial length, the wide side being wider than the narrow side;

a first lateral side extending between the narrow side and the wide side along the radial length;

a second lateral side extending between the narrow side and the wide side along the radial length, the second lateral side being distally disposed from the first lateral side; and a back surface separated from a front surface by a thickness, the back surface and the front surface extending between the wide side, narrow side, first lateral side, and second lateral side, wherein the front surface further comprises an area having a plurality of alternating refining bars and grooves, wherein the refining bars engage the substrate and wherein adjacent refining bars and the substrate define a groove between the adjacent refining bars, wherein the area of alternating refining bars and grooves is known as "a refining section", wherein the substrate further comprises a variable substrate profile disposed between the refining section and the narrow side, the variable substrate profile comprising:

a trough at a first radial position on the front surface, an adjacent crest at a second radial position on the front surface, wherein the front surface connects the trough and the adjacent crest in a sigmoid curve, and wherein the substrate further comprises a water channel having a first end disposed closer to the narrow side than a second end, the second end being disposed closer to the wide side, the substrate defining the water channel with a channel bottom and distally disposed substrate sidewalls extending between the water channel first end and the water channel second end, the water channel extending through the substrate and being disposed within the substrate below the front surface.

20. The refiner plate segment of claim 19 further comprising breaker bars disposed between the narrow side and the refining section, wherein the substrate further comprises multiple water channels extending through the substrate.

21. The refiner plate segment of claim 19, wherein the water channel is disposed in the substrate between the narrow side and the refining section.

* * * * *